US008590891B2

(12) United States Patent
Takahashi et al.

(10) Patent No.: US 8,590,891 B2
(45) Date of Patent: Nov. 26, 2013

(54) IMAGE FORMING APPARATUS, RECORDING MEDIUM CONVEYING METHOD, AND IMAGE FORMING SYSTEM

(71) Applicants: Motoharu Takahashi, Kanagawa (JP); Yusuke Ishizaki, Kanagawa (JP); Masahiro Ashikawa, Kanagawa (JP); Minoru Takahashi, Kanagawa (JP)

(72) Inventors: Motoharu Takahashi, Kanagawa (JP); Yusuke Ishizaki, Kanagawa (JP); Masahiro Ashikawa, Kanagawa (JP); Minoru Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/719,482

(22) Filed: Dec. 19, 2012

(65) Prior Publication Data

US 2013/0161900 A1 Jun. 27, 2013

(30) Foreign Application Priority Data

Dec. 21, 2011 (JP) ..... 2011-279847
Dec. 11, 2012 (JP) ..... 2012-270152

(51) Int. Cl.
*B65H 5/34* (2006.01)

(52) U.S. Cl.
USPC ..... 271/270; 271/265.01; 271/264

(58) Field of Classification Search
USPC ..... 271/270, 265.01, 264
See application file for complete search history.

(56) References Cited

U.S. PATENT DOCUMENTS

| | | | | |
|---|---|---|---|---|
| 5,018,718 | A * | 5/1991 | Matsuno et al. | 271/245 |
| 2011/0064500 | A1 | 3/2011 | Takahashi | |
| 2011/0081181 | A1* | 4/2011 | Saito | 399/395 |
| 2011/0084438 | A1* | 4/2011 | Tooker et al. | 271/3.16 |
| 2011/0175281 | A1 | 7/2011 | Takahashi | |
| 2012/0072015 | A1* | 3/2012 | Takahashi | 700/229 |

FOREIGN PATENT DOCUMENTS

| | | |
|---|---|---|
| JP | 2006-071922 | 3/2006 |
| JP | 2011-057412 | 3/2011 |
| JP | 2011-170323 | 9/2011 |

* cited by examiner

*Primary Examiner* — Luis A Gonzalez
(74) *Attorney, Agent, or Firm* — IPUSA, PLLC

(57) ABSTRACT

A recording medium conveyor includes a first conveyance part conveying a recording medium; a second conveyance part conveying the conveyed recording medium toward a transfer position; a detection part detecting the position of the recording medium conveyed by the second conveyance part; a position error detection part detecting a position error between the transfer position and a position at which there is to be the recording medium when an image reaches the transfer position; a position error storage part storing the detected position errors; a steady-state position error calculation part calculating a steady-state position error from the stored position errors; a first control part controlling the conveyance speed of the first conveyance part to reduce the steady-state position error; and a second control part controlling the conveyance speed of the second conveyance part to reduce the detected position error, with the steady-state position error being reduced.

9 Claims, 17 Drawing Sheets

FIG.16

[mm]

| | PAPER KIND 1 | PAPER KIND 2 | PAPER KIND 3 |
|---|---|---|---|
| CORRECTION 1 | 1.01 | −0.53 | −2.01 |
| CORRECTION 2 | 0.23 | −0.84 | −1.69 |
| CORRECTION 3 | 1.35 | −0.76 | −2.21 |
| ⋮ | ⋮ | ⋮ | ⋮ |
| CORRECTION n | 0.89 | −0.31 | −1.88 |

IMAGE FORMING APPARATUS, RECORDING MEDIUM CONVEYING METHOD, AND IMAGE FORMING SYSTEM

CROSS-REFERENCE TO RELATED APPLICATIONS

The present application is based upon and claims the benefit of priority of Japanese Patent Application No. 2011-279847, filed on Dec. 21, 2011, and Japanese Patent Application No. 2012-270152, filed on Dec. 11, 2012, the entire contents of which are incorporated herein by reference.

BACKGROUND OF THE INVENTION

1. Field of the Invention

The present invention relates to the conveyance of a recording medium having a sheet shape.

2. Description of the Related Art

According to electrophotographic image forming apparatuses, an electrostatic latent image is formed on a photosensitive drum using a laser, and is developed with toner into a toner image on the photosensitive drum. This toner image is transferred onto paper, and is fused onto the paper with heat or pressure, so that an image is formed on the paper.

However, the occurrence of slippage between a paper conveying roller and the paper or a change in the volume of the roller due to temperature may prevent the image from being transferred onto an ideal position on the paper. Therefore, techniques for controlling position errors have been proposed. For example, Japanese Laid-Open Patent Application No. 2011-170323 discloses an image forming apparatus configured to deliver paper to a secondary transfer part using a registration roller and a transfer timing roller, in which the rotational speed of the transfer timing roller is so controlled as to reduce position errors.

SUMMARY OF THE INVENTION

According to an aspect of the present invention, an image forming apparatus includes an image moving unit configured to move an image to a transfer position; a first recording medium conveyance unit configured to convey a recording medium to a downstream side in a conveying direction; a second recording medium conveyance unit provided on the downstream side of the first recording medium conveyance unit in the conveying direction, the second recording medium conveyance unit being configured to convey the recording medium, conveyed from the first recording medium conveyance unit, toward the transfer position; a recording medium detection unit configured to detect a position of the recording medium conveyed by the second recording medium conveyance unit; a position error detection unit configured to detect a position error between the transfer position and a position at which there is to be the recording medium when the image reaches the transfer position, based on the position of the recording medium detected by the recording medium detection unit; a position error storage unit configured to store a plurality of position errors detected by the position error detection unit; a steady-state position error calculation unit configured to calculate a steadily generated steady-state position error from the plurality of position errors stored in the position error storage unit; a first control unit configured to control a conveyance speed of the first recording medium conveyance unit so as to reduce the steady-state position error; and a second control unit configured to control a conveyance speed of the second recording medium conveyance unit so as to reduce the position error detected by the position error detection unit, with the steady-state position error being reduced by the first control unit.

According to an aspect of the present invention, a recording medium conveying method includes moving an image to a transfer position by an image moving unit; conveying a recording medium to a downstream side in a conveying direction by a first recording medium conveyance unit; conveying the recording medium, conveyed from the first recording medium conveyance unit, toward the transfer position by a second recording medium conveyance unit provided on the downstream side of the first recording medium conveyance unit in the conveying direction; detecting a position of the recording medium conveyed by the second recording medium conveyance unit by a recording medium detection unit; detecting a position error between the transfer position and a position at which there is to be the recording medium when the image reaches the transfer position, based on the position of the recording medium detected by the recording medium detection unit, by a position error detection unit; storing a plurality of position errors detected by the position error detection unit by a position error storage unit; calculating a steadily generated steady-state position error from the plurality of position errors stored in the position error storage unit by a steady-state position error calculation unit; controlling a conveyance speed of the first recording medium conveyance unit so as to reduce the steady-state position error by a first control unit; and controlling a conveyance speed of the second recording medium conveyance unit so as to reduce the position error detected by the position error detection unit, with the steady-state position error being reduced by the first control unit, by a second control unit.

According to an aspect of the present invention, an image forming system includes an image forming unit, the image forming unit including an image moving unit configured to move an image to a transfer position; a first recording medium conveyance unit configured to convey a recording medium to a downstream side in a conveying direction; a second recording medium conveyance unit provided on the downstream side of the first recording medium conveyance unit in the conveying direction, the second recording medium conveyance unit being configured to convey the recording medium, conveyed from the first recording medium conveyance unit, toward the transfer position; a recording medium detection unit configured to detect a position of the recording medium conveyed by the second recording medium conveyance unit; a position error detection unit configured to detect a position error between the transfer position and a position at which there is to be the recording medium when the image reaches the transfer position, based on the position of the recording medium detected by the recording medium detection unit; and a position error storage unit configured to store a plurality of position errors detected by the position error detection unit; a steady-state position error calculation unit configured to calculate a steadily generated steady-state position error from the plurality of position errors stored in the position error storage unit; a first control unit configured to control a conveyance speed of the first recording medium conveyance unit so as to reduce the steady-state position error; and a second control unit configured to control a conveyance speed of the second recording medium conveyance unit so as to reduce the position error detected by the position error detection unit, with the steady-state position error being reduced by the first control unit.

The object and advantages of the embodiments will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which:

FIG. 16 is a diagram illustrating corrections stored in a memory on a paper kind basis according to the fifth embodiment.

DETAILED DESCRIPTION OF THE PREFERRED EMBODIMENTS

As described above, Japanese Laid-Open Patent Application No. 2011-170323 discloses the technique of controlling the rotational speed of the transfer timing roller to reduce position errors. Unfortunately, however, this method cannot completely correct a relative position error between an image and paper.

Figure 1:
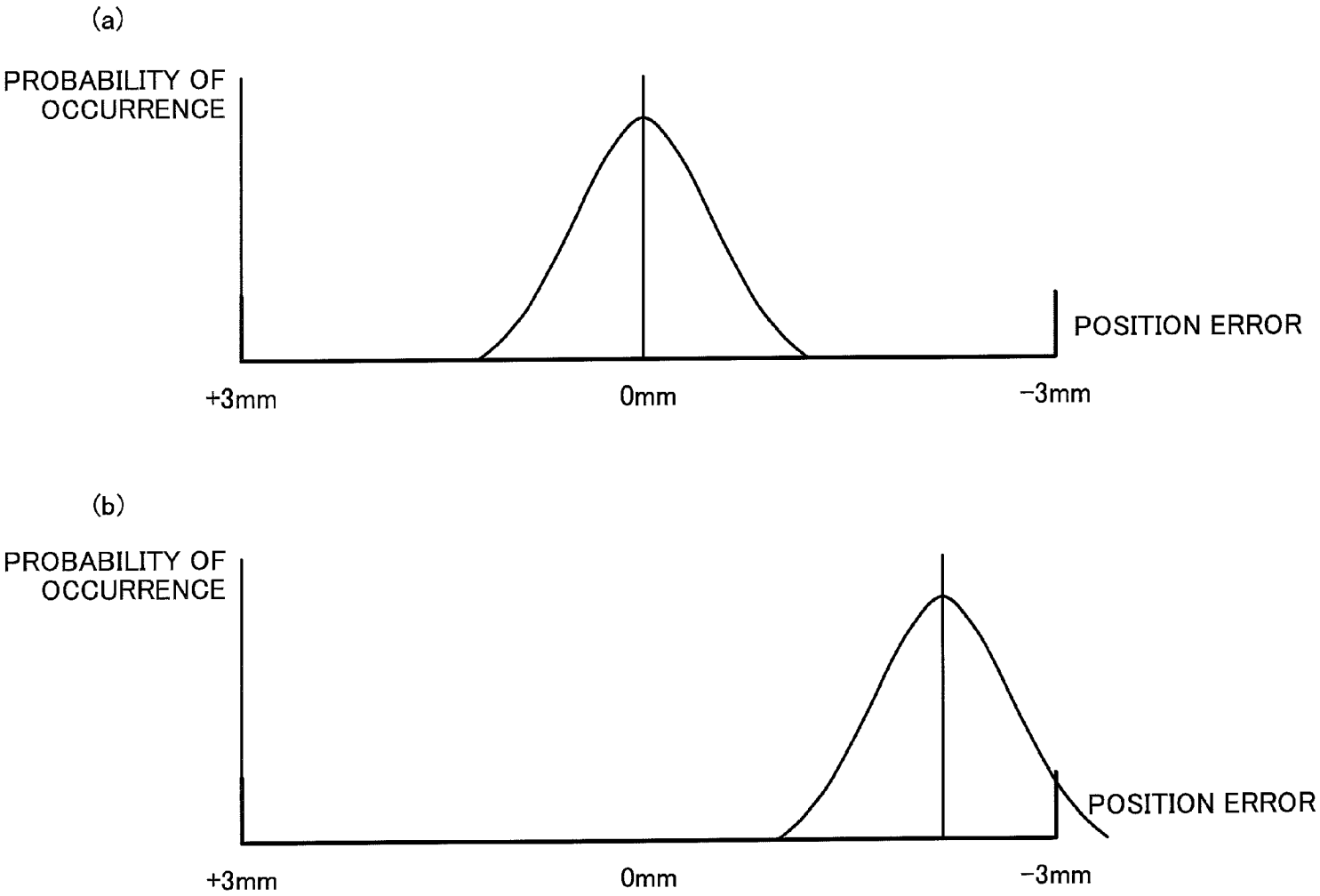
FIG.1 RELATED ART
FIG. 1 is a diagram illustrating a problem of conventional art.

FIG. 1 is a diagram for illustrating such a technical problem. In FIG. 1, (a) illustrates a case that may be regarded as free of position errors and (b) illustrates a case with large position errors. In FIG. 1, the probability of occurrence is plotted against the position error (amount) like a graph. As illustrated, the position error is not always the same value, but there is such a tendency in the size of the position error that the position error has a center of distribution at a value of the highest frequency.

If the median of the position error is around "0 mm" as illustrated in (a) of FIG. 1, even a maximum position error may be absorbed by controlling the rotational speed of the transfer timing roller, so that the misregistration may be approximated t zero. However, if the median of the position error is large as illustrated in (b) of FIG. 1, controlling the rotational speed of the transfer timing roller may not completely absorb the position error in the case of occurrence of a large variation in the position error. That is, while the median of the position error is less than "3 mm" in (b) of FIG. 1, a maximum position error may exceed "3 mm." Since the transfer timing roller and the secondary transfer part are positioned close, it may be difficult to absorb the position error by increasing or decreasing the rotational speed of the transfer timing roller alone if the position error is steadily large.

According to an aspect of the present invention, a recording medium conveyor, an image forming apparatus, a recording medium conveying method, and an image forming system are provided that make it possible to reduce or eliminate the position error of an image relative to paper.

A description is given below, with reference to the accompanying drawings, of one or more embodiments of the present invention.

Figure 2:
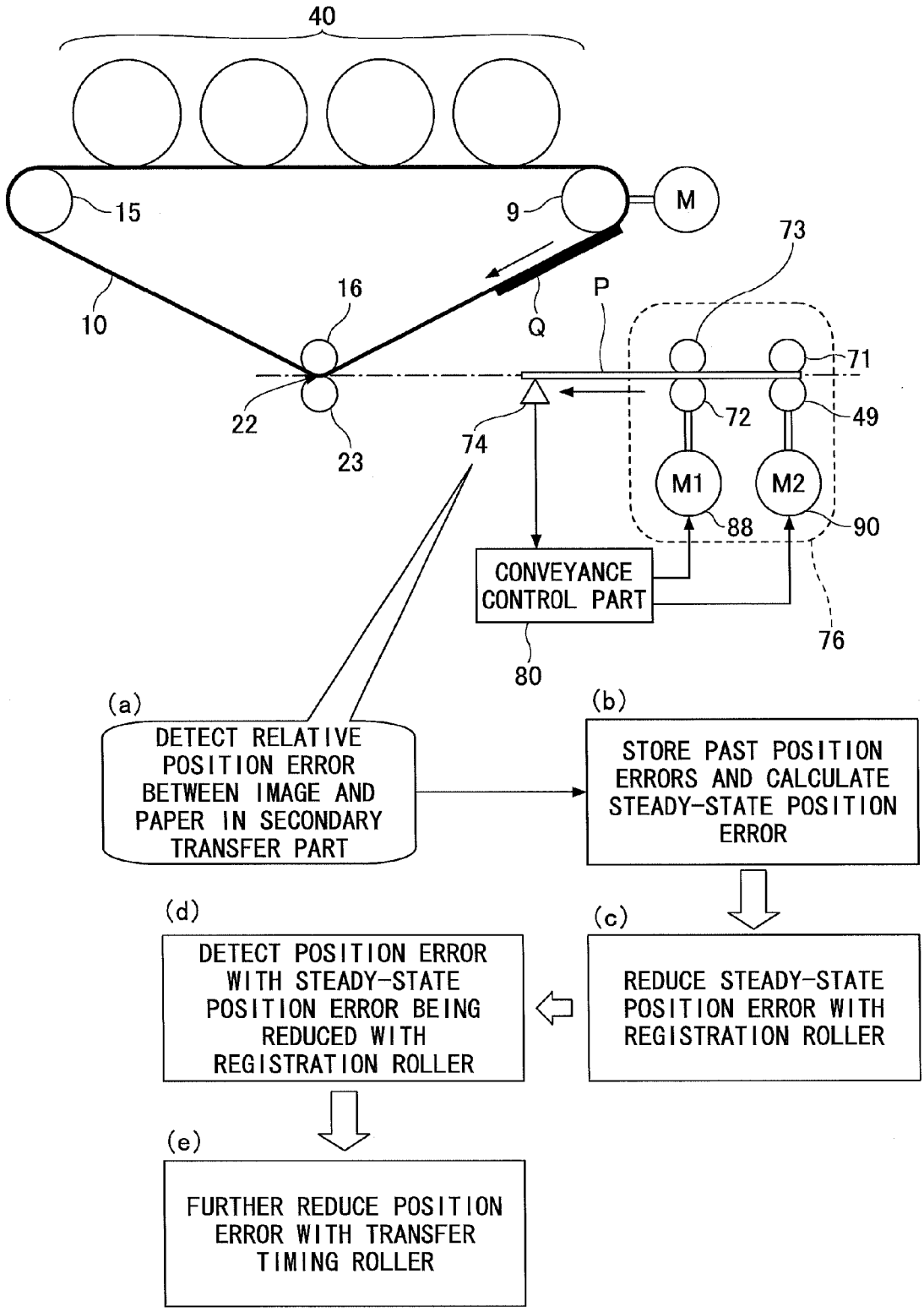
FIG. 2 is a diagram illustrating general features of an image forming apparatus according to a first embodiment of the present invention.

FIG. 2 is a diagram illustrating general features of an image forming apparatus according to an embodiment of the present invention. As illustrated in FIG. 2, according to the image forming apparatus, a paper detection sensor 74 is provided between a transfer timing roller 72 and a secondary transfer part 22.

According to the image forming apparatus of FIG. 2, (a) a conveyance control part 80 detects a relative position error between an image on an intermediate transfer belt 10 and paper (for example, a sheet of paper) P in the secondary transfer part 22 based on the position of the paper P detected by the paper detection sensor 74; (b) the conveyance control part 80 stores the last X position errors (X is a natural number greater than one). The position error is not always the same (in amount). Accordingly, correcting the position of the paper P based only on a single measured position error may result in an overcorrection (excessive correction) or an undercorrection (insufficient correction). While variable, however, the position error has a tendency. Therefore, storing the past (last) multiple position errors (error values) makes it possible to understand how likely the paper P is to be delayed or advanced as a tendency. The conveyance control part 80 calculates this tendency as a steady-state position error; (c) the conveyance control part 80 reduces the steady-state position error by controlling the rotational speed of a registration roller 49; (d) reducing the steady-state position error alone may not reduce the position error to zero. Therefore, the conveyance control part 80 further detects a relative position error between the image on the intermediate transfer belt 10 and the paper P in the secondary transfer part 22; and (e) the conveyance control part 80 reduces the position error by controlling the rotational speed of the transfer timing roller 72 with the steady-state position error being reduced.

Thus, even with a relatively large position error being generated, it is possible to approximate the position error to zero by performing a two-stage correction, that is, reducing the steady-state position error with the registration roller 49 and reducing the position error with the transfer timing roller 72.

In the following description, the position error may be referred to as a "correction (amount)." Likewise, the steady-state position error may be referred to as a "steady-state correction value." This is because the position error is treated as a correction in control, and the information of the position error and the information of the correction are equal.

Figure 3:
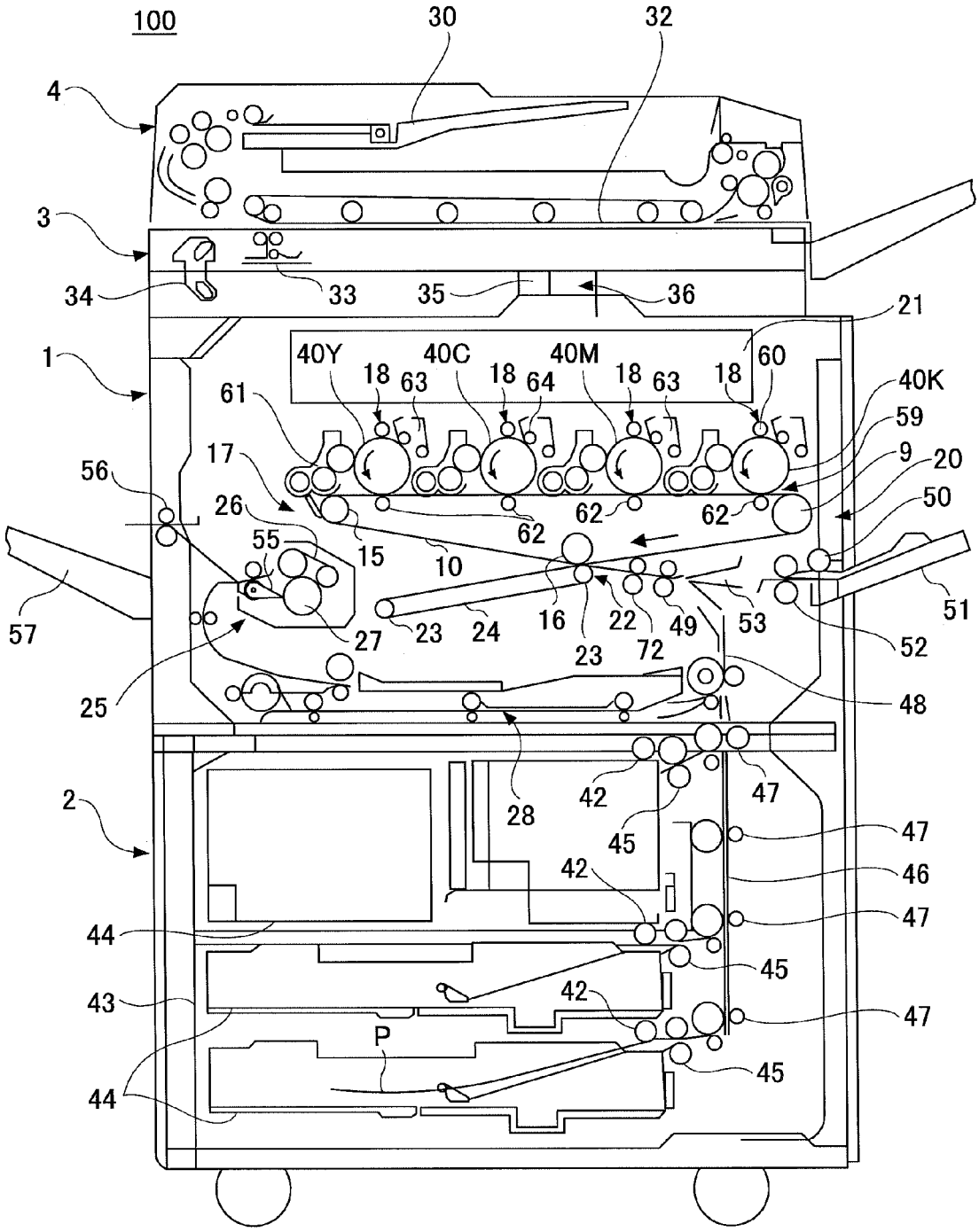
FIG. 3 is a schematic diagram illustrating a configuration of the image forming apparatus according to the first embodiment.

FIG. 3 is a schematic diagram illustrating a configuration of an image forming apparatus 100 according to an embodiment. The image forming apparatus 100 of FIG. 3 performs image forming by electrophotography. However, paper conveyance control according to this embodiment may be applied to image forming apparatuses irrespective of their systems for image forming as long as the image forming apparatuses are configured to feed paper in accordance with the moving position of an image. Further, paper (the paper P) is one of examples of recording media, and may be replaced with any (recording) medium as long as the medium is a sheet-shaped medium conveyable in image forming apparatuses.

The image forming apparatus 100 includes a paper feed table 2, an apparatus body 1 mounted on the paper feed table 2, a scanner attached on the apparatus body 1, and an automatic document feeder (ADF) 4 attached to the scanner 3. The intermediate transfer belt 10, which is a belt-shaped endless moving member, is provided in the substantial center of the apparatus body 1.

The image forming apparatus 100 further includes a transfer unit 20. The intermediate transfer belt 10 is placed in the transfer unit 20. The intermediate transfer belt 10 is stretched between a driving roller 9 and two driven rollers 15 and 16. The driving roller 9 rotates with a driving force from a driving force transmission part such as an intermediate transfer driving motor M (FIG. 2), so that the intermediate transfer belt 10 rotates clockwise in FIG. 3.

Residual toner remaining on the surface of the intermediate transfer belt 10 after the transfer of an image is removed by a cleaning unit 17 provided on the downstream side of the driven roller 15 in the moving (rotation) direction of the intermediate transfer belt 10. Four photosensitive (photoconductor) drums 40Y, 40C, 40M, and 40K, which are carriers of yellow (Y), cyan (C), magenta (M), and black (K) images, respectively, are arranged at predetermined intervals along the moving direction of the intermediate transfer belt 10 over its linear portion between the driving roller 9 and the driven roller 15. Hereinafter, the photosensitive drums 40Y, 40C, 40M, and 40K may be collectively referred to as "photosensitive bodies 40" (FIG. 2) when the individual photosensitive drums 40Y, 40C, 40M, and 40K are not identified. Four primary transfer rollers 62 are provided opposite the photosensitive bodies 40 inside the intermediate transfer belt 10 so that the intermediate transfer belt 10 is held between the photosensitive bodies 40 and the primary transfer rollers 62. Further, a primary transfer part 59, where the photosensitive bodies 40 and the corresponding primary transfer rollers 62 are in press contact through the intermediate transfer belt 10, is formed between the photosensitive bodies 40 and the corresponding primary transfer rollers 62.

The four photosensitive bodies 40 are rotatable counterclockwise in FIG. 3. A charging unit 60, a developing unit 61, the primary transfer roller 62, a photosensitive body cleaning unit 63, and a discharge unit 64 are provided around each of the photosensitive bodies 40 to form an image forming (creation) unit 18.

A shared exposure unit 21 is provided above the four image forming units 18. Images (toner images) Q (FIG. 2) formed on the respective photosensitive drums 40 are successively transferred onto the intermediate transfer belt 10 to be directly superposed one over another by the primary transfer part 59. In the following description, a signal that is output when the photosensitive bodies 40 are exposed to light by the exposure unit 21 is referred to as an "Image Write Start signal."

The secondary transfer part 22, which serves as a transfer part that transfers the images Q superposed on the intermediate transfer belt 10 onto the paper P, is provided under the intermediate transfer belt 10. The secondary transfer part 22 is formed by the press contact of the driven roller 16 and one of two rollers 23. For example, a secondary transfer belt 24, which is an endless belt, is stretched between the two rollers 23, and the secondary transfer belt 24 comes into press contact with (pressed against) the driven roller 16 through the intermediate transfer belt 10. The secondary transfer part 22 may be configured with a roller alone without a belt.

The secondary transfer part 22 transfers the toner images Q on the intermediate transfer belt 10 together onto the paper P fed between the secondary transfer belt 24 and the intermediate transfer belt 10. A fusing unit 25 that fuses (fixes) the toner images Q onto the paper P is provided on the downstream side of the secondary transfer part 22 in the paper conveying direction (moving direction). In the fusing unit 25, a pressure roller 27 is pressed against a fusing belt 26, which is an endless belt.

The secondary transfer part 22 also serves to convey the paper P onto which the toner images Q have been transferred to the fusing unit 25. The secondary transfer part 22 may be a transfer unit that uses a transfer roller or a contactless charger. A paper reversing unit 28 that reverses the paper P in the case of forming the toner images Q on each side of the paper P is provided below the secondary transfer part 22. Thus, the apparatus body 1 forms a tandem color image forming apparatus using an indirect transfer process.

In the case of making a color copy with this color image forming apparatus, a user may place an original material (such as a document) on a document table 30 of the automatic document feeder 4. In the case of manually setting the original material, the user opens the automatic document feeder 4 and places the original material on contact glass 32 of the scanner 3. Then, the user closes and holds the automatic document feeder 4.

In response to the depression of a Start key (not graphically illustrated), the original material is fed onto the contact glass 32 when placed on the automatic document feeder 4. When the original material is manually set on the contact glass 32, the scanner 3 is immediately driven in response to the depression of the Start key, so that a first running body 33 and a second running body 34 start running. Then, light is emitted onto the original material from the light source of the first running body 33. The light reflected from the surface of the original material travels toward the second running body 34, and is reflected by the mirrors of the second running body 34 to enter a read sensor 36 through an imaging lens 35. Thereby, the contents of the original material are read.

Further, in response to the above-described depression of the Start key, the intermediate transfer belt 10 starts rotating, and at the same time, the photosensitive bodies 40Y, 40C, 40M, and 40K start rotating and an operation is started to form the single-color toner images Q of yellow (Y), cyan (C), magenta (M), and black (K) on the photosensitive bodies 40Y, 40C, 40M, and 40K, respectively. The respective color toner images Q formed on the photosensitive bodies 40Y, 40C, 40M, and 40K are successively transferred onto the intermediate transfer belt 10 rotating clockwise to be superposed one over another, so that a full-color composite color image is formed on the intermediate transfer belt 10. This composite color image may also be referred to by the same reference symbol "Q" as the respective toner images.

In response to the above-described depression of the Start key, a paper feed roller 42 of a selected paper feed tier inside the paper feed table 2 rotates, so that sheets of paper P are sent out from a selected one of paper feed cassettes 44 in a paper bank 43. A corresponding separation roller 45 separates one sheet at a time from the rest of the sheets of paper P, so that the sheets of paper P are conveyed one by one to a paper feed path 46. The sheet of paper P is conveyed to a paper feed path 48 inside the apparatus body 1 by conveyor rollers 47, and runs into the registration roller 40 to be temporarily stopped.

In the case of manual feed, sheets of paper P set on a manual tray 51 are sent out by the rotation of a paper feed roller 50. A separation roller 52 separates one sheet at a time from the rest of the sheets of paper P, so that the sheets of paper P are conveyed one by one to a manual paper feed path 53. The conveyed sheet of paper P runs into the registration roller 49 to be temporarily stopped. The registration roller 49 times its start of rotation exactly to the toner images Q on the intermediate transfer belt 10, and sends in the temporarily stopped sheet of paper P between the intermediate transfer belt 10 and the secondary transfer part 22. The composite color image is transferred onto the sheet of paper P in the secondary transfer part 22.

The sheet of paper P onto which the color image has been transferred is conveyed to the fusing unit 25 by the secondary transfer part 22, which also serves as a conveying unit. The fusing unit 25 applies heat and pressure to the transferred color image, so that the color image is fused onto the sheet of paper P. Thereafter, the sheet of paper P is guided to the output side by a switch claw 55, and is output (discharged) onto a paper output tray 57 by an output roller 56 to be stacked on the paper output tray 57. When a duplex copy mode is selected, the sheet of paper P having an image formed on one side is directed toward the paper reversing unit 28 by the switch claw 55. The sheet of paper P is reversed in the paper reversing unit 28 to be again guided to the secondary transfer part 22 (a transfer position), where an image is formed on the other side of the sheet of paper P this time. Thereafter, the sheet of paper P is output onto the paper output tray 57 by the output roller 56.

[a] Embodiment 1

Figure 4:
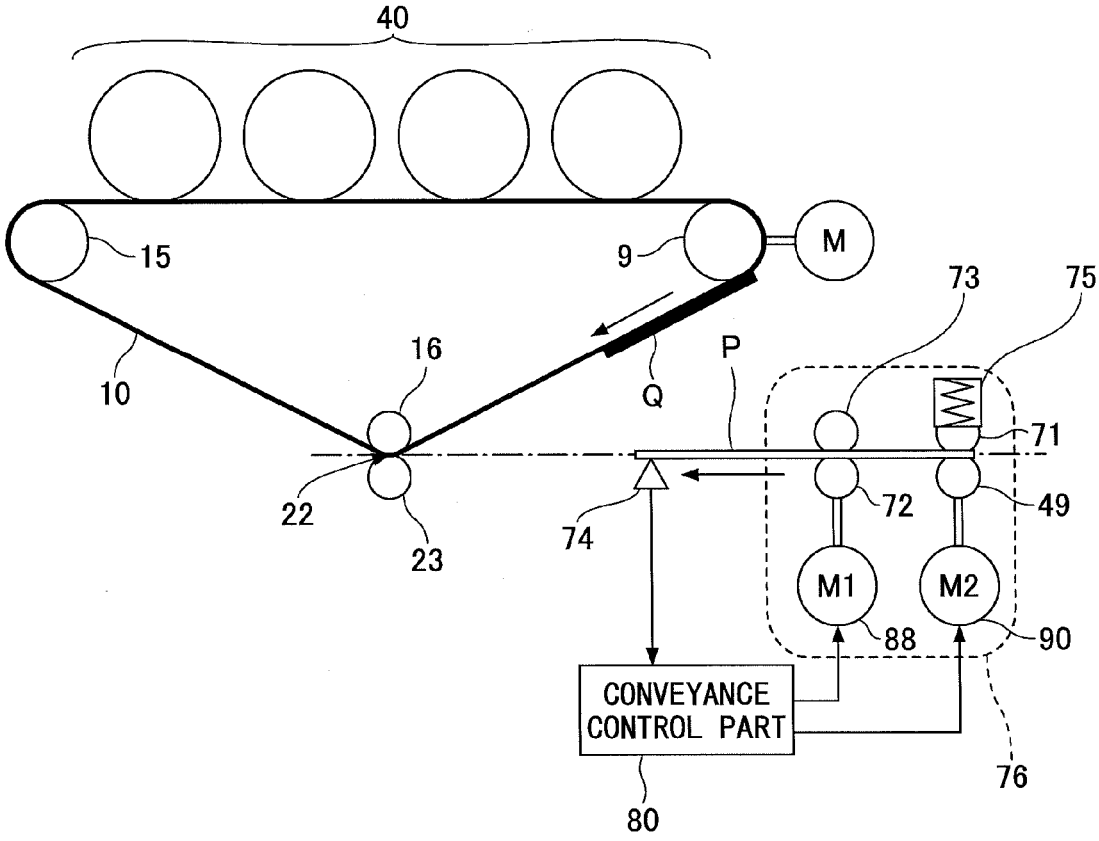
FIG. 4 is a diagram illustrating a configuration of an intermediate transfer belt and a secondary transfer part according to a second embodiment (Embodiment 1) of the present invention.

FIG. 4 is a diagram illustrating a configuration of the intermediate transfer belt 10 and the secondary transfer part 22 according to this embodiment. The sheet of paper P is conveyed to the secondary transfer part 22 by a paper conveying part 76. The paper conveying part 76 includes the transfer timing roller 72 (a second recording medium conveyance unit), a driven roller 73, the registration roller 49 (a first recording medium conveyance unit), and a driven roller 71. The transfer timing roller 72 is driven to rotate by a first motor 88 (M1), and the registration roller 49 is driven to rotate by a second motor 90 (M2). The timing of a start of rotation, the rotational speed, and the timing of a stop of rotation of each of the first and second motors 88 and 90 are controlled by the conveyance control part 80.

The paper detection sensor 74 (a recording medium detection unit) is placed on the upstream side of the secondary transfer part 22 on the downstream side of the transfer timing roller 72 in the paper conveying direction. The paper detection sensor 74 detects the leading edge of the paper P having reached the paper detection sensor 74, the paper P passing the paper detection sensor 74, and the trailing edge of the paper P having passed the paper detection sensor 74. The paper detection sensor 74 is preferably placed immediately before the secondary transfer part 22 in order to detect the time of arrival of the paper P at the secondary transfer part 22.

Further, as described below, the paper detection sensor 74 is used to detect a relative position error (amount) between the image Q on the intermediate transfer belt 10 (an image moving unit) and the conveyed paper P. The position error is used to correct the rotational speed of the transfer timing roller 72 (the first motor 88). Further, the position error is recorded multiple times (that is, multiple position errors are recorded) to be used to determine the steady-state position error of the image Q relative to the paper P. The steady-state position error is used to correct the rotational speed of the registration roller 49 (the second motor 90).

The transfer timing roller 72 serves as a distance relay and conveys the paper P from the registration roller 49 to the secondary transfer part 22. If the registration roller 49 and the transfer timing roller 72 differ in rotational speed, their different rotational speeds may interfere with each other during the conveyance of the paper P by the two rollers 49 and 72 together. In order to eliminate this, the paper conveying part 76 further includes a registration roller contact/separation mechanism 75 that separates the registration roller 49 and the driven roller 71 when the paper P reaches the transfer timing roller 72. This allows the paper P to be conveyed by the transfer timing roller 72 alone.

Figure 5:
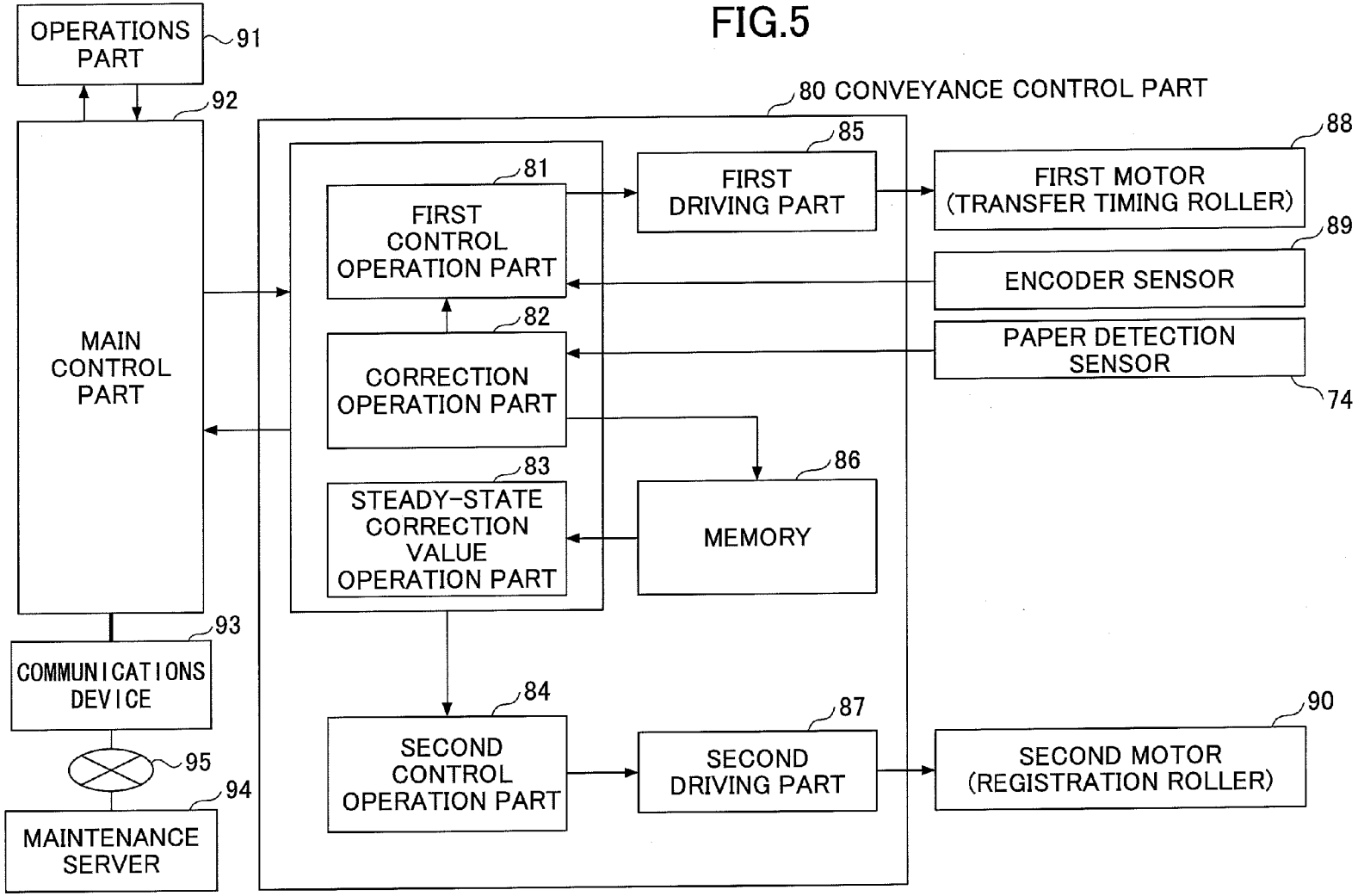
FIG. 5 is a functional block diagram illustrating a conveyance control part according to the second embodiment.

FIG. 5 is a functional block diagram illustrating the conveyance control part 80. The conveyance control part 80 is connected to a main control part 92, and controls paper conveyance based on instructions from the main control part 92. The main control part 92 is connected to an operations part 91, a communications device 93, a scanner control part (not graphically illustrated), an image forming control part (not graphically illustrated), etc., in addition to the conveyance control part 80.

The operations part 91, which includes a liquid crystal display unit and a keyboard, displays various operation menus on the liquid crystal display unit and receives instructions from a user. A touchscreen panel is integrated with the liquid crystal display unit.

The communications device 93 is, for example, a network interface card (NIC), and is connected to a maintenance server 94 via a network 95 such as a local area network (LAN). The main control part 92 communicates with apparatuses connected to the network 95, such as the maintenance server 94, through software-based communications with the communications device 93.

The main control part 92 is one form of microcomputers, boards, and information processors that include a central processing unit (CPU), a read-only memory (ROM), a random access memory (RAM), an input/output (I/O) interface, a communications part for communications with other boards, a hard disk drive (HDD), and an integrated circuit (IC).

The main control part 92 receives instructions from the operations part 91, such as those for copying the original material and printing out image data stored in the HDD. The main control part 92 also receives image data and instructions for printing out the received image data through the communications device 93. In the following description, these instructions may be collectively referred to as a "print instruction." The main control part 92 generates various timing control signals for the synchronization of the control parts, thereby allowing the conveyance control part 80 to feed the paper P to the secondary transfer part 22 with appropriate timing. Here, for simplification, a description is given of timing control signals in the case of a printout operation without document scanning by the scanner control part.

Figure 6:
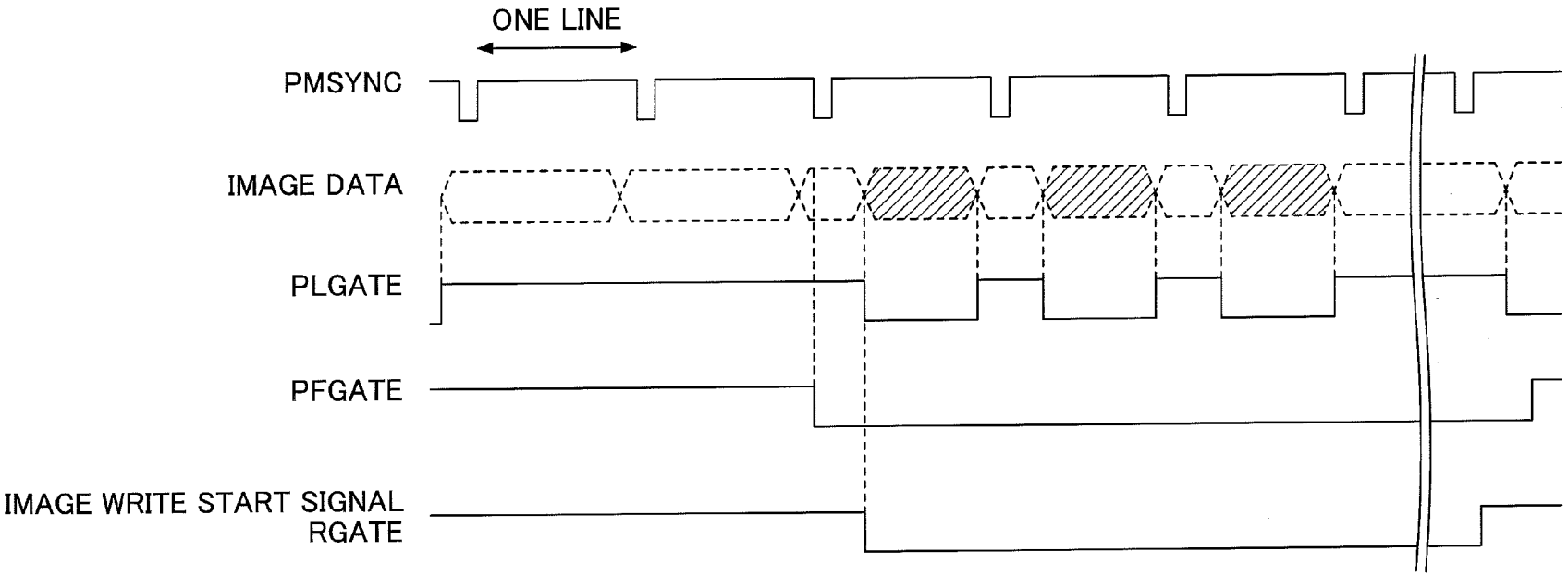
FIG. 6 is a timing chart of signals illustrating timing control signals according to the second embodiment.

FIG. 6 is a timing chart of signals illustrating timing control signals. When receiving a print instruction, first, the main control part 92 notifies the image forming control part and the conveyance control part 80 of the print instruction. The image forming control part causes a laser diode to emit laser light onto a rotating polygon mirror. The laser light is detected by a photodetector every time the laser light is reflected by one surface of the polygon mirror. The time interval of this reflection by one surface is a scanning time for one line. The image forming control part generates a main scanning synchronization signal PMSYNC from the interval of the detection by the photodetector, and supplies the main scanning synchronization signal PMSYNC to the main control part 92.

The main control part 92 generates a main scanning valid period signal PLGATE and a sub scanning valid period signal PFGATE by counting pixel clock pulses each corresponding to one pixel with reference to the main scanning synchronization signal PMSYNC. The main scanning valid period signal PLGATE is asserted (LOW in FIG. 6) when valid data are present in a line. The sub scanning valid period signal PFGATE is asserted (LOW in FIG. 6) when valid data are present in the sub scanning direction. When both the main scanning valid period signal PLGATE and the sub scanning valid period signal PFGATE are asserted, the main control part 92 asserts a signal RGATE. Thus, the signal RGATE indicates the start of recording on a photosensitive drum (a corresponding one of the photosensitive bodies 40) by the laser light, and may be used as the above-described Image Write Start signal. The Image Write Start signal does not have to be the signal RGATE, and may be delayed or advanced by a few pixel clock pulses with reference to the instant at which the signal RGATE becomes active (asserted).

Referring back to FIG. 5, like the main control part 92, the conveyance control part 80 may be regarded as an information processor. In cooperation with one or more programs and hardware such as an IC, the conveyance control part 80 implements a first control operation part 81 (a second control unit), a correction operation part 82, a steady-state correction value operation part 83, a second control operation part 84 (a first control unit), a first driving part 85, a memory 86, and a second driving part 87.

As described above, upon receiving a print instruction from the main control part 92, the conveyance control part 80 extracts a sheet of paper P from one of the paper feed cassettes 44 by controlling a clutch, a solenoid, etc., on the paper feed conveyance path side. The sheet of paper P is detected with a registration sensor (not graphically illustrated), and temporarily stops at the registration roller 49. The conveyance control part 80 starts counting time. When the time measured with reference to the Image Write Start signal exceeds a predetermined time T, the conveyance control part 80 rotates the registration roller 49 by controlling the second motor 90, and sends out the paper P to the transfer timing roller 72. The transfer timing roller 72 conveys the paper P conveyed from the registration roller 49 to the secondary transfer part 22. According to this embodiment, the second control operation part 84 of the conveyance control part 80 controls the rotational speed of the second motor 90 based on the steady-state position error, thereby adjusting time it takes for the paper P to reach the transfer timing roller 72 from the registration roller 49. As a result, the first-stage of position error correction is performed, so that it is possible to reduce a relative position error between the image Q and the paper P.

Some types of image forming apparatuses do not cause the paper P to temporarily stop at the registration roller 49, while other types of image forming apparatuses do not have the registration roller 49. In these cases, the time it takes for the paper P to reach the transfer timing roller 72 is adjusted by controlling the conveyance speed with a roller on the upstream side of the transfer timing roller 72 in the paper conveying direction.

First, the first control operation part 81 outputs a speed instruction value for the first motor 88 in the form of a pulse width modulation (PWM) signal or the like to the first driving part 85 (for example, a motor control circuit) based on the target speed of the first motor 88. The rotational speed of the first motor 88 is detected by an encoder sensor 89, and is fed back to the first control operation part 81. The first control operation part 81 performs feedback control based on the detected rotational speed of the first motor 88, so that the first motor 88 rotates at the target speed. As described below, the first control operation part 81 corrects the target speed based on the correction (amount) calculated by the correction operation part 82.

The correction operation part 82 is connected to the paper detection sensor 74. The correction operation part 82 calculates a correction and a position error. The position error is a difference (offset) between an ideal position at which the paper P is supposed to be and an actual position at which the paper P is going to be when the image Q on the intermediate transfer belt 10 reaches the secondary transfer part 22. The correction is a difference between the time at which the image Q on the intermediate transfer belt 10 reaches the secondary transfer part 22 and the time at which the paper P reaches the secondary transfer part 22. It is the correction that is directly monitored.

A description is given of a method of calculating the correction. As described above, the paper detection sensor 74 detects a predetermined position (for example, the leading edge) of the paper P, and outputs a paper detection signal to the correction operation part 82. Further, the conveyance control part 80 is provided with the Image Write Start signal. It is assumed that the rotational speeds of the photosensitive bodies 40 and the intermediate transfer belt 10 are constant irrespective of their age or substantially unchanged due to periodic maintenance. Therefore, an image arrival (reaching) time, or the time from the detection of the Image Write Signal up to the arrival of the image Q at the secondary transfer part 22, may be regarded as constant.

Meanwhile, slippage may be caused between the registration roller 49 or the transfer timing roller 72 and the paper P or the registration roller 49 or the transfer timing roller 72 may change in volume because of temperature. Therefore, a paper arrival time, or the time from the start of conveyance of the paper P by the registration roller 49 up to the arrival of the paper P at the secondary transfer part 22, may be different from an ideal value. Therefore, even when the conveyance control part 80 starts driving the registration roller 49 after passage of the predetermined time T determined from the Image Write Start signal, the sum of the time T and the paper arrival time may not be equal to the image arrival time (Image Arrival Time≠Time T+Paper Arrival Time).

Accordingly, the difference between the image arrival time and the sum of the time T and the paper arrival time is the correction. Further, since the correction is detected in terms of time, the position error may also be uniquely determined from the conveyance speed of the registration roller 49 or the transfer timing roller 72 as follows:

Correction=Image Arrival Time−(Time *T*+Paper Arrival Time), and

Position Error=Correction×Conveyance Speed.

For example, the correction is determined as follows:

(a) first, an ideal time th from the start of conveyance of the paper P at an ideal speed Vh by the conveyance control part 80 up to the detection of the leading edge of the paper P by the paper detection sensor 74 is set in response to the start of formation of electrostatic images on the photosensitive bodies 40 (that is, the output of the Image Write Start signal) as a trigger. Here, the ideal speed th is the conveyance speed of the paper P (the conveyance control part 80) that is supposed to cause no relative position error between the image Q and the paper P;

(b) next, a real time tr from the start of conveyance of the paper P at an actual (current) speed Vr up to the detection of the leading edge of the paper P by the paper detection sensor 74 is measured at the time of the output of the Image Write Start signal the same as in (a);

(c) a time difference between the real time tr and the ideal time th, Δt=tr−th, is calculated; and (d) by multiplying the time difference Δt by the ideal time th (that is, by calculating Δt×Vh), a correction ΔX at the time of the detection of the leading edge of the paper P by the paper detection sensor 74 is calculated.

The correction operation part 82 stores the correction ΔX thus determined in the memory 86. The correction operation part 82 also outputs the correction ΔX to the first control operation part 81. For example, the past (last) approximately 10 to approximately 1000 corrections ΔX are stored in the memory 86 while updating the corrections ΔX by replacing the oldest correction ΔX with the newest correction ΔX. By storing the past (last) multiple corrections (correction values), it is possible to determine a steady-state value of correction.

The steady-state correction value operation part 84 reads out corrections from the memory 86 and calculates a steady-state value, for example, when a predetermined number of new corrections have been calculated, immediately after the image forming apparatus 100 is started, when a predetermined time has passed since the last determination of the steady-state value, or in a period of time during which the image forming apparatus 100 is not used by a user.

Figure 7:
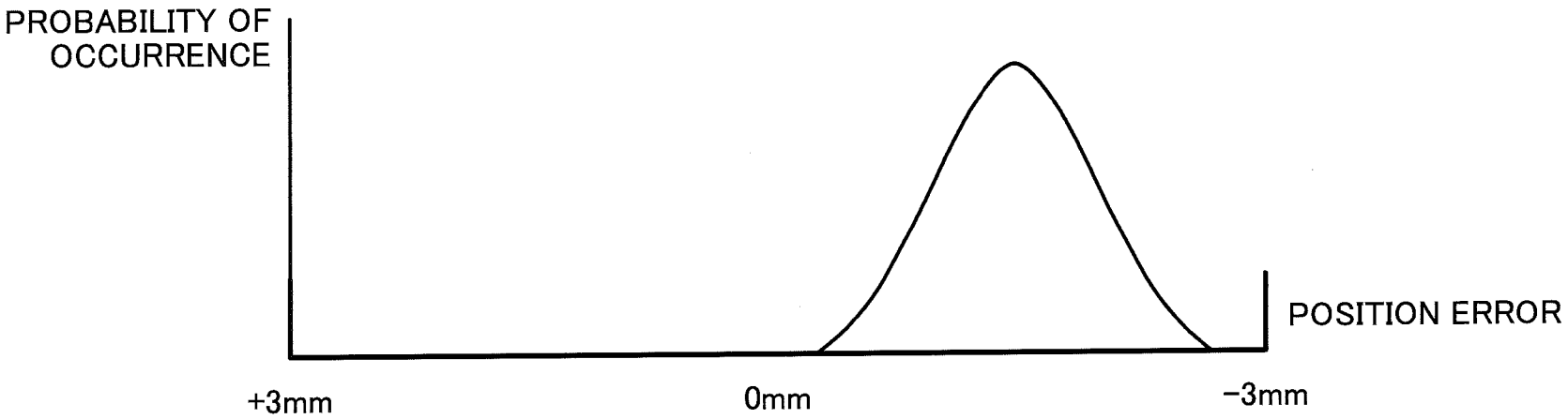
FIG. 7 is a graph illustrating a method of deriving a steady-state value according to the second embodiment.

FIG. 7 is a graph illustrating a method of deriving a steady-state value. In FIG. 7, the probability of occurrence is plotted against the position error (amount) like a graph. Such a graph may be created by creating a histogram of position errors and dividing the cumulative value of each position error by the number of all plotted data. In FIG. 7, the graph is illustrated with the position error, while a graph of the same shape may be obtained by illustration with the correction.

The steady-state position error may be derived from the past (last) X position errors recorded (X is a natural number greater than one). A position error of "0 mm" means the absence of a position error. The steady-state position error is supposed to present a positive or negative constant value. In practice, however, the probability of occurrence of the steady-state position error has a certain width. Therefore, the steady-state correction value operation part 84 calculates a steady-state correction value in one of the following methods. According to this embodiment, the steady-state correction value is employed as the steady-state position error.

(a) The average of the past (last) X position errors is determined as the steady-state correction value.

(b) The maximum value and the minimum value of the past (last) X position errors are added up and divided by two. The resultant value is determined as the steady-state correction value.

(c) A position error whose probability of occurrence of the past (last) X times is the highest among the position errors is determined as the steady-state correction value.

The steady-state correction value operation part 83 outputs the steady-state correction value to the second control operation part 84. When the steady-state correction value is greater than a threshold, the second control operation part 84 controls the rotational speed of the second motor 90 so as to cancel out the steady-state correction value by the rotational speed of the registration roller 49.

The speed command value that the second control operation part 84 outputs to the second motor (the second driving part 87) may be calculated by the following equation:

Speed Command Value={Distance between Transfer Timing Roller 72 and Registration Roller 49/(Distance between Transfer Timing Roller 72 and Registration Roller 49+Steady-State Correction Value)}×(Conveyance Speed before Correcting *X* Position Errors). (1)

That is, a conveyance speed to which the steady-state correction value corresponds is calculated as the speed command value. By the second control operation part 84 controlling the second motor 90 with this speed command value, it is possible to cancel out the steady-state correction value by the rotational speed of the registration roller 49.

The conveyance control part 80 may output the steady-state correction value to the main control part 92, so that the main control part 92 may transmit the steady-state correction value to the maintenance server 94 via the communications device 93. The maintenance server 94 monitors the steady-state correction value, and determines whether to go and perform maintenance or estimates a failure for an excessively large steady-state correction value.

Figure 8:
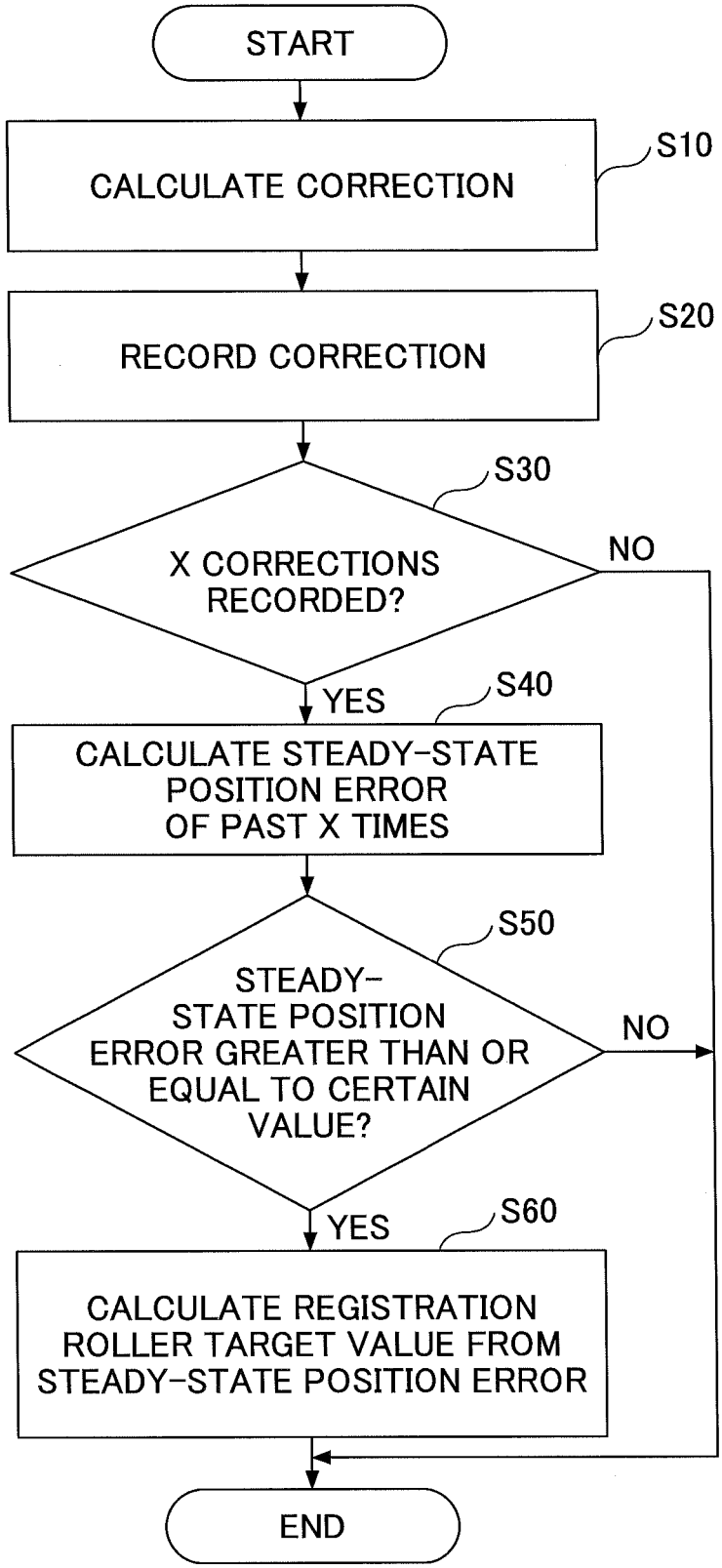
FIG. 8 is a flowchart illustrating a process up to the calculation of a speed command value by the conveyance control part according to the second embodiment.

FIG. 8 is a flowchart illustrating a process up to the calculation of a speed command value by the conveyance control part 80.

In step S10, the correction operation part 82 calculates at least one of the correction and the position error from the result of paper detection by the paper detection sensor 74 and the Image Write Start signal.

In step S20, the correction operation part 82 records the correction or the position error in the memory 86.

In step S30, the steady-state correction value operation part 83 determines whether the correction or the position error has been recorded X times. If the correction or the position error has not been recorded X times (NO in step S30), the process ends without calculating the steady-state correction value.

If the correction or the position error has been recorded X times (that is, if X corrections or X position errors have been recorded) (YES in step S30), in step S40, the steady-state correction value operation part 83 calculates the steady-state correction value from the past (last) X corrections or position errors recorded in the memory 86.

In step S50, the second control operation part 84 determines whether the steady-state correction value is greater than or equal to a threshold. If the steady-state correction value of the recorded past (last) X corrections or position errors is not greater than or equal to a threshold (NO in step S50), the second control operation part 84 does not change the speed command value.

If the steady-state correction value of the recorded past (last) X corrections or position errors is greater than or equal to a threshold (YES in step S50), in step S60, the second control operation part 84 changes the speed command value by Eq. (1) described above.

Figure 9:
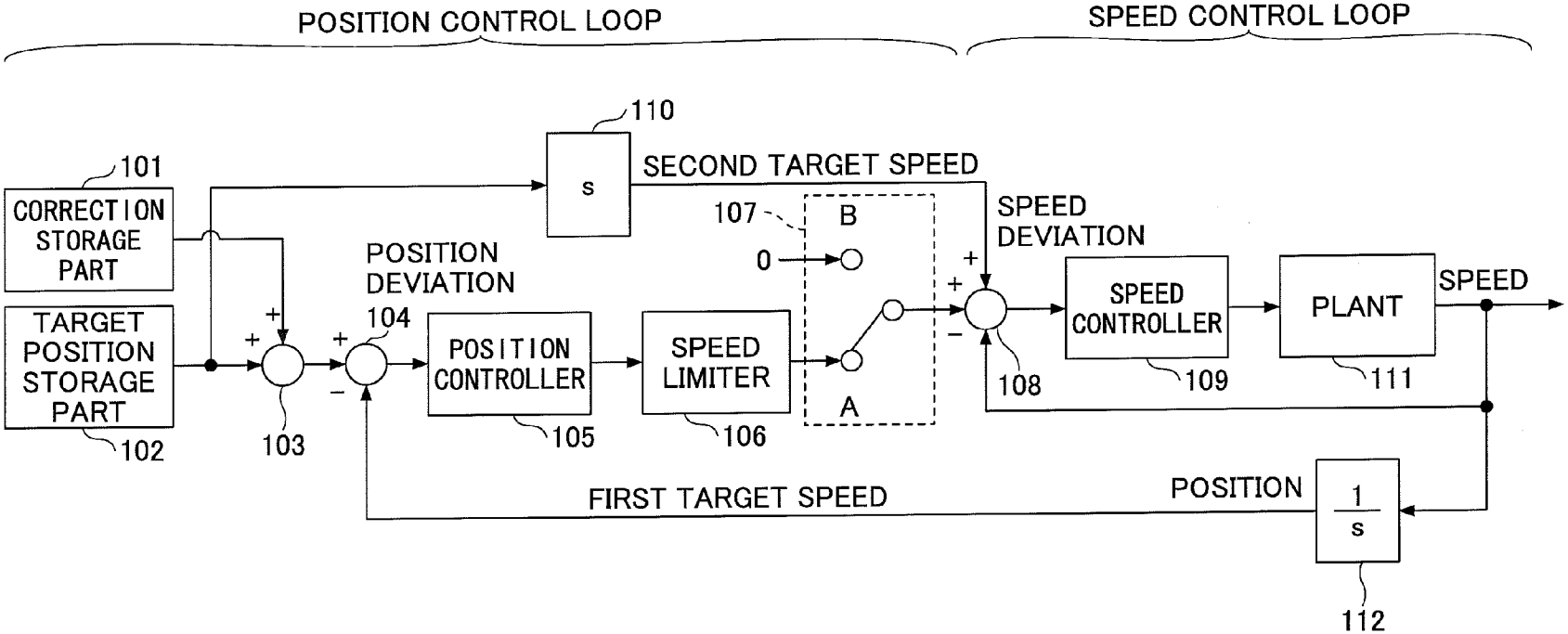
FIG. 9 is a control block diagram illustrating control of the rotational speed of a transfer timing roller by the conveyance control part according to the second embodiment.

FIG. 9 is a control block diagram illustrating control of the rotational speed of the transfer timing roller 72 (FIG. 4) by the conveyance control part 80 (FIG. 5). More specifically, FIG. 9 is a control block diagram in the case of the first control operation part 81 controlling the first motor 88 (FIG. 5). The control block diagram is a mere representation of a control logic. The configuration as graphically illustrated may exist as hardware or be implemented as software.

Referring to FIG. 4 and FIG. 5 as well, the second operation part 84 has already controlled the rotational speed of the registration roller 49 based on the steady-state correction value. Therefore, a correction that is nevertheless generated is corrected as the rotational speed of the transfer timing roller 72 by the first control operation part 81. This allows the relative position error between the image Q and the paper P to be approximated to zero.

A correction storage part 101 stores a correction calculated by the correction operation part 82. Although expressed as a "correction," this correction is "Position Error=Correction× Conveyance Speed" because the transfer timing roller 72 is subjected to position control and speed control.

The correction stored in the correction storage part 101 may be the last correction calculated by the correction operation part 82 or the average of the last multiple (approximately two to approximately ten) corrections.

A target position storage part 102 stores a target position that the first control operation part 81 calculates in accordance with a target speed. The target position is a position to which the transfer timing roller 72 feeds the paper P (the amount of feed of the paper P). The first operation control part 81 calculates the target position by taking the integral of the target speed with respect to a micro time, and stores the calculated target position in a target position storage part 102.

For example, the first control operation part 81 starts control at the same time with the second control operation part 84. Alternatively, the first control operation part 81 may start control when the paper P reaches the transfer timing roller 72 after the second control operation part 84 starts the rotation of the registration roller 49.

The correction of the correction storage part 101 and the target position of the target position storage part 102 are added up by an adder 103. Since the correction takes a positive or negative value, the target position is corrected to a greater value if the correction is positive, and to a smaller value if the correction is negative.

The corrected target position is compared with an actually measured position detected by the encoder sensor 89 by a comparator 104. In FIG. 9, plant 111 is an object of control (a control target), to which the transfer timing roller 72 (or the first motor 88) corresponds according to this embodiment. The rotational speed of the transfer timing roller 72 detected by the encoder sensor 89 is subjected to integration in an integrator circuit (1/s) 112 to be input to the comparator 104. As a result, the comparator 104 outputs a position deviation between the corrected target position and the actually measured position. Here, "s" is a Laplace transform operator, and $s=d/dt$ so that $1/s=\int dt$.

A position controller 105 performs a compensator operation based on the position deviation, and outputs a target speed calculated from the position deviation. PI control, PID control, etc., are known logics of compensators. The compensator operation may also be performed based on other logics such as the modern control theory and the robust control theory.

The output of the position controller 105 is a target speed viewed from the position of the transfer timing roller 72 to the internal speed control loop. However, it is preferable to limit the output of the position controller 105 in view of avoiding the saturation of the control target and in terms of the speed specifications (maximum and minimum values of speed and the upper and lower limits of speed changes).

Therefore, a speed limiter 106 imposes limitations on the target speed, such as "not exceeding a maximum value," "not falling below a minimum value," "preventing a change (in the target speed) from exceeding an upper limit," and "preventing a change (in the target speed) from falling below a lower limit." The target speed output by the speed limiter 106 is input to a switch part 107.

The switch part 107 switches a target speed input to the speed control loop. The switching may be performed by a person in charge of the maintenance of the image forming apparatus 100 (a maintenance person) or a user of the image forming apparatus 100. The maintenance person may determine which of End A and End B is to be input to the speed control loop (whether to input the target speed of the position control loop to the speed control loop) from the operations part 91. In place of the maintenance person or a user, the image forming apparatus 100 may switch a target speed to be input to the speed control loop. If the paper P is thick paper, the registration roller 49 and the transfer timing roller 72 may interfere with each other, so that a position variation may act on the transfer timing roller 72. In this case, position control by the transfer timing roller 72 may apply a great force to the paper P. Therefore, for example, if the paper P is hard, it is effective for a user to prevent the position control loop from being put into operation.

When the switch part 107 connects End A and the speed control loop, a first target speed determined by the position control loop (a target speed for performing position control including the correction) may be determined as the target speed of the speed control loop. In this case, the target position stored in the target position storage part 102 is unnecessary. Therefore, a second target speed determined by the differentiation of the target position of the target position storage part 102 by a differentiator circuit 110 is not input to the speed control loop.

When the switch part 107 connects End B and the speed control loop, zero may be determined as the target speed of the speed control loop. Therefore, in this case, the position control loop may be regarded as non-operating. In this case, the second target speed determined by the differentiation of the target position of the target position storage part 102 by the differentiator circuit 110 (a steady-state speed for conveying the paper P) is input to the speed control loop.

The first target speed (including zero), the second target speed, and the rotational speed of the transfer timing roller 72 detected by the encoder sensor 89 are input to a comparator 108 of the speed control loop. The comparator 108 compares and calculates a speed deviation between the sum of the first target speed and the second target speed and the rotational speed, and inputs the calculated speed deviation to a speed controller 109.

The speed controller 109 performs a compensator operation based on the speed deviation, and outputs the amount of speed control calculated from the speed deviation. PI control, PID control, etc., are known logics of compensators. The compensator operation may also be performed based on other logics such as the modern control theory and the robust control theory.

Figure 10:
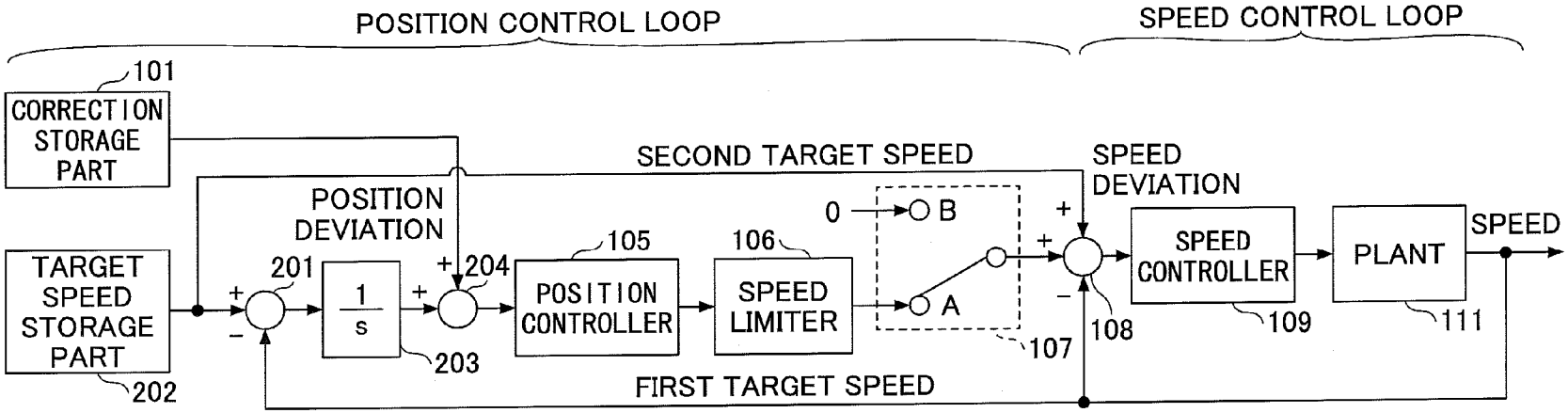
FIG. 10 is another control block diagram illustrating control of the rotational speed of the transfer timing roller by the conveyance control part according to the second embodiment.

FIG. 10 is another control block diagram illustrating control of the rotational speed of the transfer timing roller 72

(FIG. 4) by the conveyance control part 80 (FIG. 5). In FIG. 10, the same elements as those of FIG. 9 are referred to by the same reference numerals, and are briefly described.

According to the control block illustrated in FIG. 10, in place of a target position, a target speed stored in a target speed storage part 202 is input to the position control loop. The target speed may be calculated by the differentiation of a target position by the first control operation part 81 (FIG. 5).

Referring to FIG. 4 and FIG. 5 as well, the target speed of the target speed storage part 202 is input to a comparator 201. The rotational speed of the transfer timing roller 72 detected by the encoder sensor 89 is input to the comparator 201. Therefore, the comparator 201 compares and outputs a speed deviation between the target speed and the measured rotational speed. The speed deviation is subjected to integration in an integrator circuit 203 to be converted into a position deviation. The position deviation and the correction of the correction storage part 101 are input to an adder 204. Accordingly, the position deviation is corrected to a greater value if the correction is a positive value and to a smaller value if the correction is a negative value.

The position controller 105 performs a compensator operation based on the corrected position deviation, and outputs a target speed calculated from the position deviation. PI control, PID control, etc., are known logics of compensators. The compensator operation may also be performed based on other logics such as the modern control theory and the robust control theory. The subsequent speed limiter 106 and switch part 107 have the same configuration as in FIG. 9.

To the speed control loop, the target speed of the target speed storage part 202 (a second target speed) or a first target speed output by the position control loop is input. The comparator 108 compares and calculates a speed deviation between the first target speed or the second target speed and the rotational speed, and inputs the calculated speed deviation to the speed controller 109.

The speed controller 109 performs a compensator operation based on the speed deviation, and outputs the amount of speed control calculated from the speed deviation. PI control, PID control, etc., are known logics of compensators. The compensator operation may also be performed based on other logics such as the modern control theory and the robust control theory.

The control block of the second control operation part 84 (FIG. 5) that controls the rotational speed of the registration roller 49 may be configured the same as illustrated in FIG. 9. In this case, the correction of FIG. 9 is made zero (the speed command value includes the correction), and a value determined by taking the integral of the speed command value with respect to time is the output of the target position storage part 102. In the case of configuring the control block of the second control operation part 84 the same as illustrated in FIG. 10, the correction is made zero, and the speed command value is output from the target speed storage part 202.

As described above, according to the image forming apparatus 100 of this embodiment, a relative position error between the image Q and the paper P is recorded, and a steady-state position error is calculated. As a result, it is possible to make a correction so as to reduce the steady-state position error that may cause a great position error, using the registration roller 49 on the upstream side of the transfer timing roller 72 in the paper conveying direction. Further, a relative position error between the image Q and the paper P that remains even after the correction of the rotational speed of the registration roller 49 may be approximated to zero by controlling the rotational speed of the transfer timing roller 72.

[b] Embodiment 2

In this embodiment, a description is given of a configuration of the image forming apparatus 100 where the paper conveying part 76 does not have the registration roller contact/separation mechanism 75.

Figure 11:
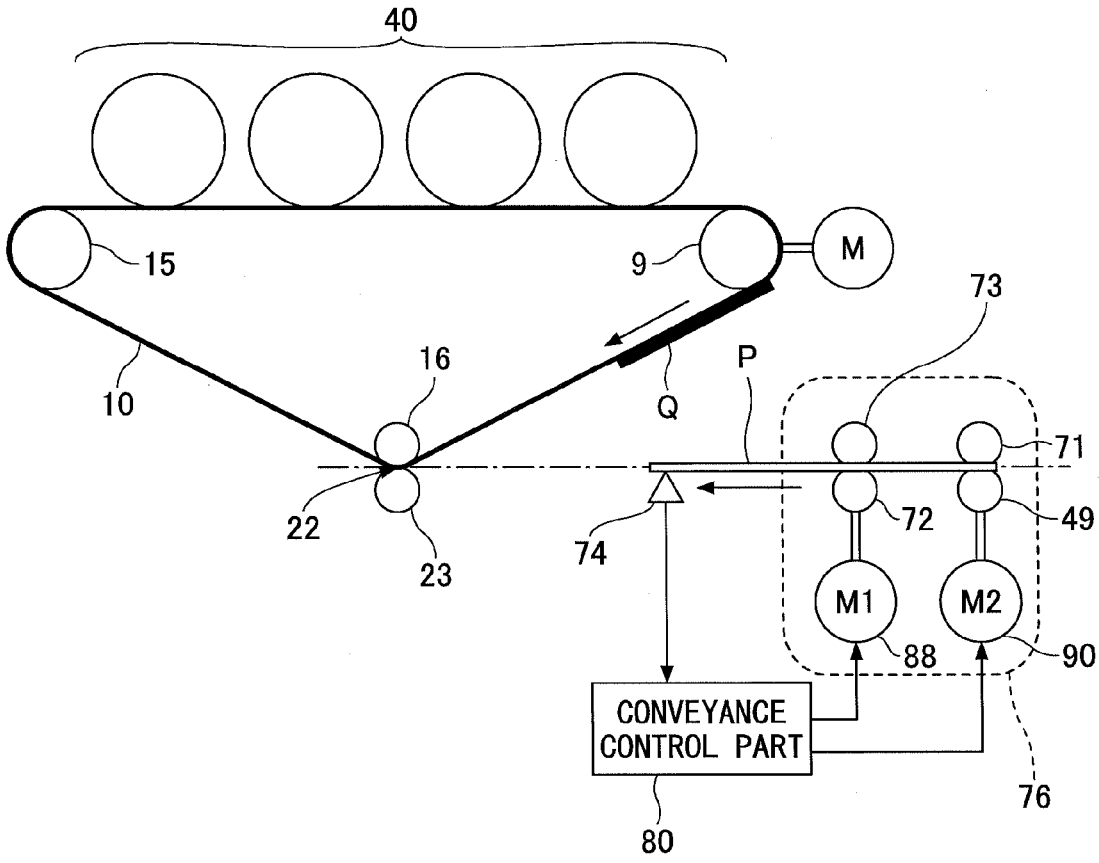
FIG. 11 is a diagram illustrating a configuration of the intermediate transfer belt and the secondary transfer part according to a third embodiment (Embodiment 2) of the present invention.

FIG. 11 is a diagram illustrating a configuration of the intermediate transfer belt 10 and the secondary transfer part 22. In FIG. 11, the same elements as those of FIG. 4 are referred to by the same reference numerals, and a description thereof is omitted. According to this embodiment, the paper conveying part 76 does not have the registration roller contact/separation mechanism 75 that separates the registration roller 49 and the driven roller 71.

Therefore, according to this embodiment, in order to eliminate interference in the case of both the transfer timing roller 72 and the registration roller 49 conveying the paper P, the conveyance control part 80 changes the speed of conveyance by the transfer timing roller 72.

When the paper P is over both the registration roller 49 and the transfer timing roller (that is, during the conveyance of the paper P by both the registration roller 49 and the transfer timing roller 72), there is no interference (through the paper P) if the registration roller 49 and the transfer timing roller 72 rotate at the same rotational speed. As described above in Embodiment 1, according to this embodiment, the conveyance control part 80 corrects the rotational speed of the registration roller 49 in order to correct a steady-state position error. Therefore, letting the corrected conveyance speed of the registration roller 49 be the target speed of the transfer timing roller 72 makes it possible to prevent interference between the registration roller 49 and the transfer timing roller 72.

In this case, taking the control block diagram of FIG. 10 of Embodiment 1 as an example, the speed command value calculated by the steady-state correction value operation part 83 is set in the target speed storage part 202. For example, when the rotational speed of the registration roller 49 is changed from V1 to V2 in order to cancel out a steady-state position error, the first operation control part 81 also changes the conveyance speed of the transfer timing motor 72 before correction (the target speed of the target speed storage part 202 of FIG. 10) to V2. As a result, it is possible to eliminate interference between the transfer timing roller 72 and the registration roller 49 in conveying the paper P.

The rotational speed of the transfer timing roller 72 is controlled with the correction of the correction storage part 101, so that the rotational speed of the transfer timing roller 72 may not be equal to the rotational speed of the registration roller 49. There are several methods for preventing this inconvenience, of which a simple one is to reduce the correction of the correction storage part 101 to a fraction or zero.

Further, as another method, the second control operation part 84 makes the second motor 90 less responsive to a speed change until the trailing edge of the paper P leaves the registration roller 49 after the leading edge of the paper P has reached the transfer timing roller 72. For example, in PI control, a constant of integration ki is made zero in the case of calculating a speed control value as follows:

$$\text{Speed Control Value} = kp \times \text{Speed Deviation} + ki \times \int \text{Speed Deviation}\, dt.$$

Making the constant of integration ki zero means that there is only proportional control. Proportional control has the characteristic that the amount of control is stabilized in a state close to a target value as the amount of control approaches the target value. Therefore, making the constant of integration ki zero means generation of a steady-state speed deviation (the deviation of the rotational speed from a target speed). However, even when the constant of integration ki becomes zero, the registration roller 49 stops pushing the transfer timing roller 72 while sharing a paper conveyance load because of the action of a constant of proportionality kp. When the rotational speed of the registration roller 49 becomes lower than the rotational speed of the transfer timing roller 72, the transfer timing roller 72 conveys the paper P while providing the paper P with slight tension. That is, the registration roller 49 behaves like a driven roller of the transfer timing roller 72. Accordingly, it is possible to prevent interference in speed with the transfer timing roller 72 due to a mismatch in rotational speed between the transfer timing roller 72 and the registration roller 49.

According to this embodiment, in addition to the effects according to Embodiment 1, it is possible to prevent the registration roller 49 and the transfer timing roller 72 from interfering with each other.

[c] Embodiment 3

In Embodiments 1 and 2 described above, the steady-state correction value operation part 83 calculates the steady-state correction value. However, if the steady-state correction value is known in advance, there is no need for the steady-state correction value operation part 83 to calculate the steady-state correction value. According to this embodiment, a description is given of a configuration of the image forming apparatus 100 where the steady-state correction value is pre-stored.

A functional block diagram of the conveyance control part 80 is the same as FIG. 5. According to this embodiment, the conveyance control part 80 calculates the steady-state correction value before shipment of the image forming apparatus 100, so that the steady-state correction value measure before shipment is stored in the memory 86.

According to this embodiment, by controlling the rotational speed of the registration roller 49 based on this pre-measured steady-state correction value, the second control operation part 84 may cancel out a steady-state position error that is determined after being detected over a long period of time. Like in Embodiment 1 or 2, the first control operation part 81 controls the rotational speed of the transfer timing roller 72.

Figure 12:
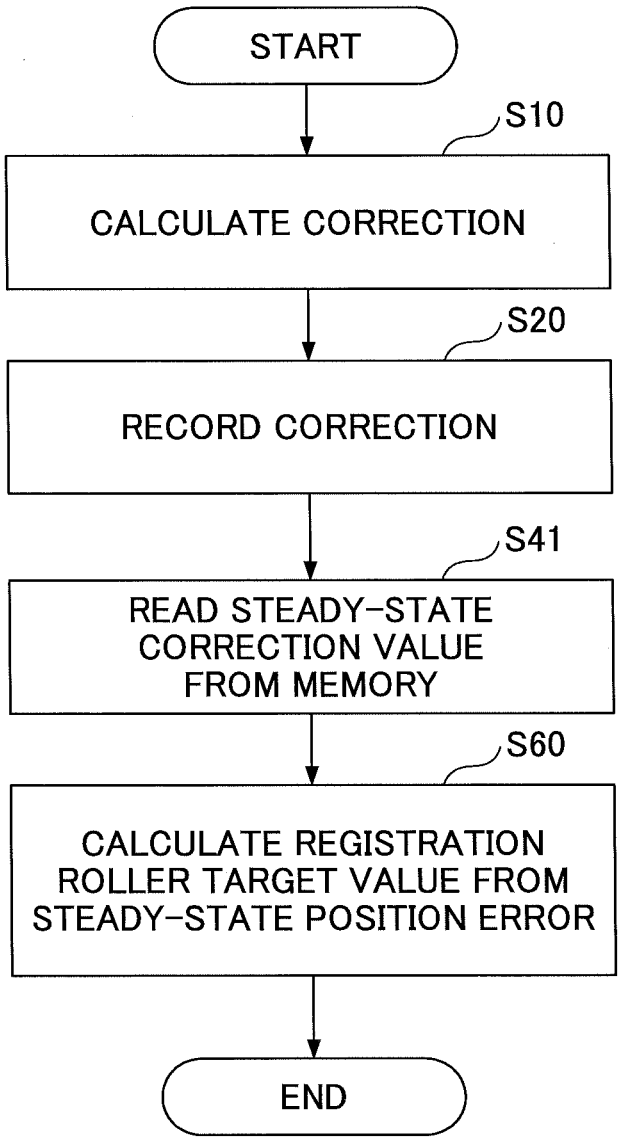
FIG. 12 is a flowchart illustrating a process up to the calculation of a speed command value by the conveyance control part according to a fourth embodiment (Embodiment 3) of the present invention.

FIG. 12 is a flowchart illustrating a process up to the calculation of a speed command value by the conveyance control part 80. The process of FIG. 12 is similar to the process of FIG. 8, but includes step S41 in place of steps S30 and S40 based on the processing of the steady-state correction value operation part 83.

Further, in this embodiment, the process of steps S10 and S20, which may be necessary only for control of the rotational speed of the transfer timing roller 72, may be unnecessary before step S41.

In step S41, the second control operation part 84 reads the steady-state correction value from the memory 86. In step S60, the second control operation part 84 changes the speed command value using Eq. (1) of Embodiment 1.

Next, a description is given of a case where the steady-state correction value operation part 83 is provided outside the image forming apparatus 100.

The steady-state correction value operation part 83, which calculates the steady-state correction value from corrections or position errors, may not be provided inside the image forming apparatus 100.

Figure 13:
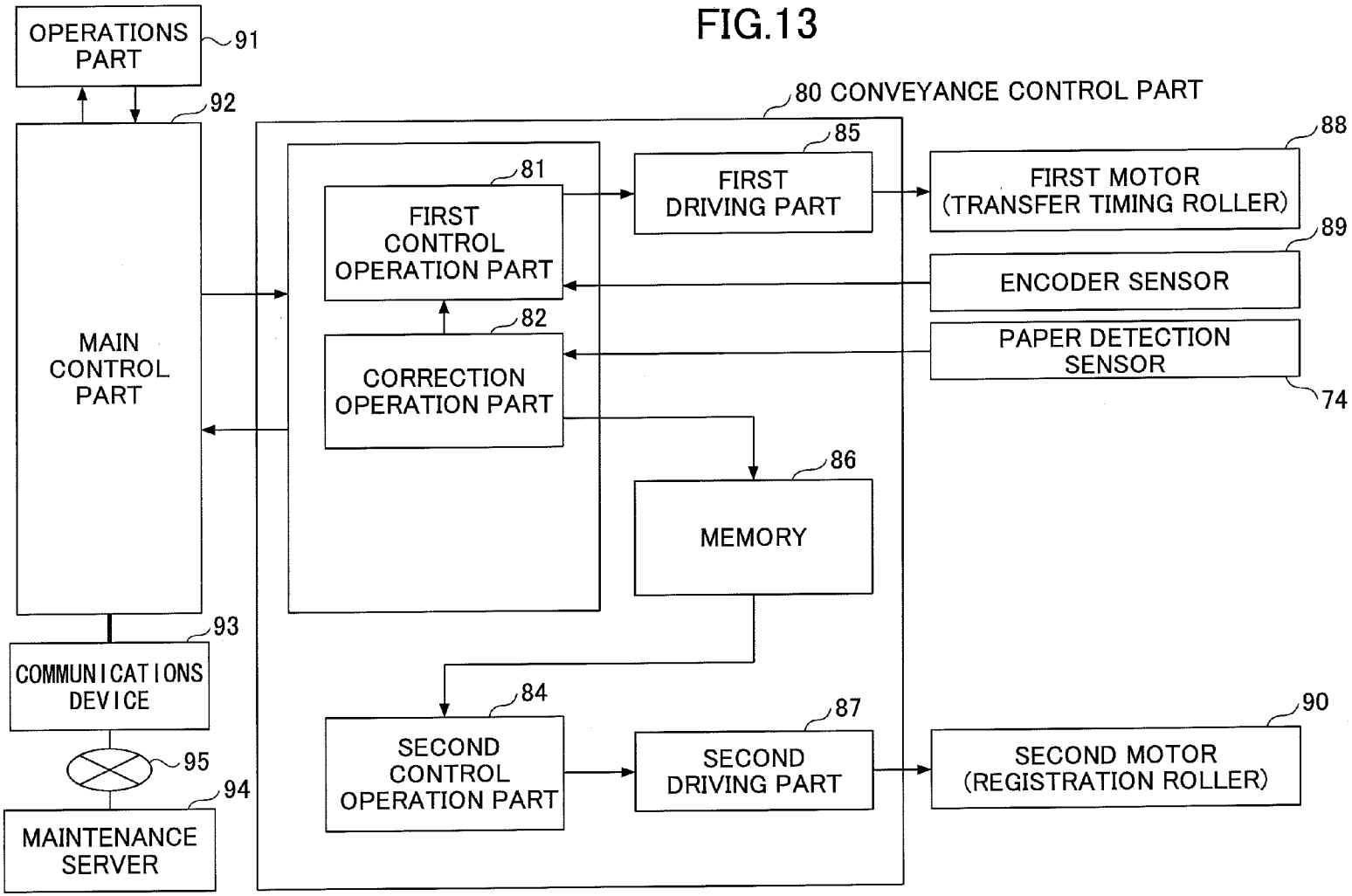
FIG. 13 is a functional block diagram illustrating the conveyance control part according to the fourth embodiment.

FIG. 13 is a functional block diagram illustrating the conveyance control part 80. In FIG. 13, the same elements as those of FIG. 5 are referred to by the same reference numerals, and a description thereof is omitted. In FIG. 13, the conveyance control part 80 does not include the steady-state correction value operation part 83. However, a steady-state correction value measured by a manufacturer before shipment is stored in the memory 86. Alternatively, a steady-state correction value measured by a maintenance person through periodic maintenance using an external apparatus may be stored in the memory 86. By prestoring the steady-state correction value in the memory 86, it is possible to omit the steady-state correction value operation part 83.

The image forming apparatus 100 may also use a steady-state correction value created by an external apparatus. The external apparatus may be referred to as, for example, a server, an external controller, a digital front end or the like. A description is given below of a case where the external apparatus is a server.

Figure 14A:
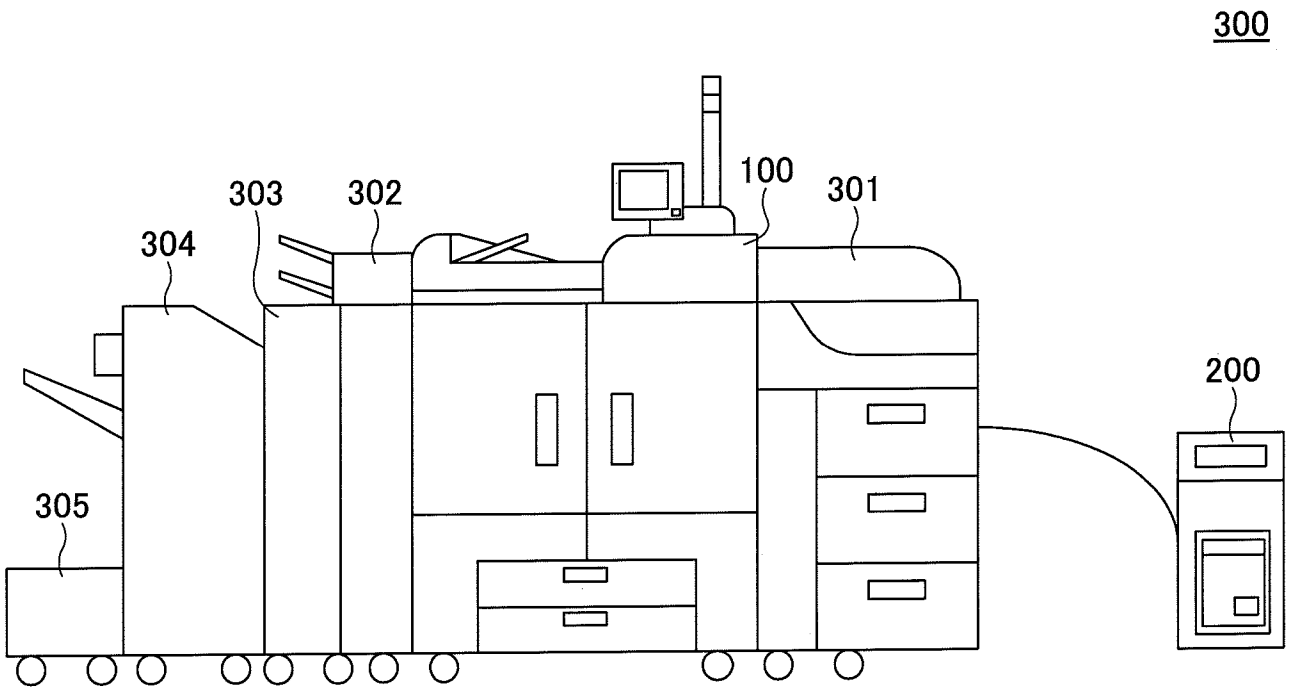
FIGS. 14A and 14B are schematic diagrams illustrating an image forming system including a server and the image forming apparatus according to the fourth embodiment.

FIG. 14A is a schematic diagram illustrating an image forming system 300 including a server 200 and the image forming apparatus 100. The image forming system 300 of FIG. 14A is an example of a production printing machine capable of performing large-quantity, high-speed and high-quality printing. The image forming apparatus 100 is used with peripheral devices having functions of paper feeding, folding, stapling, cutting, etc., being connected to the image forming apparatus 100. For example, a large-capacity paper feed unit 301, an inserter 302 used for using a cover and the like, a folding unit 303, a finisher 304 that performs stapling and punching, a cutter 305, etc., are used in combination in accordance with the purpose of printing.

The image forming apparatus 100 is connected to the server 200. The server 200 may include the steady-state correction value operation part 83 and the memory 86. The image forming apparatus 100 transmits the correction (correction values) or the position error (position error values) to the server 200. The server 200 stores the received correction or position error in the memory 86, and calculates the steady-state correction value from the received correction or position error. The server 200 may also store the calculated steady-state correction value in the memory 86. The server 200 transmits the steady-state correction value to the image forming apparatus 100, and the image forming apparatus 100 stores the steady-state correction value. Therefore, the memory 86 in which the steady-state correction value is stored may be described as being provided in both the image forming apparatus 100 and the server 200.

Figure 14B:
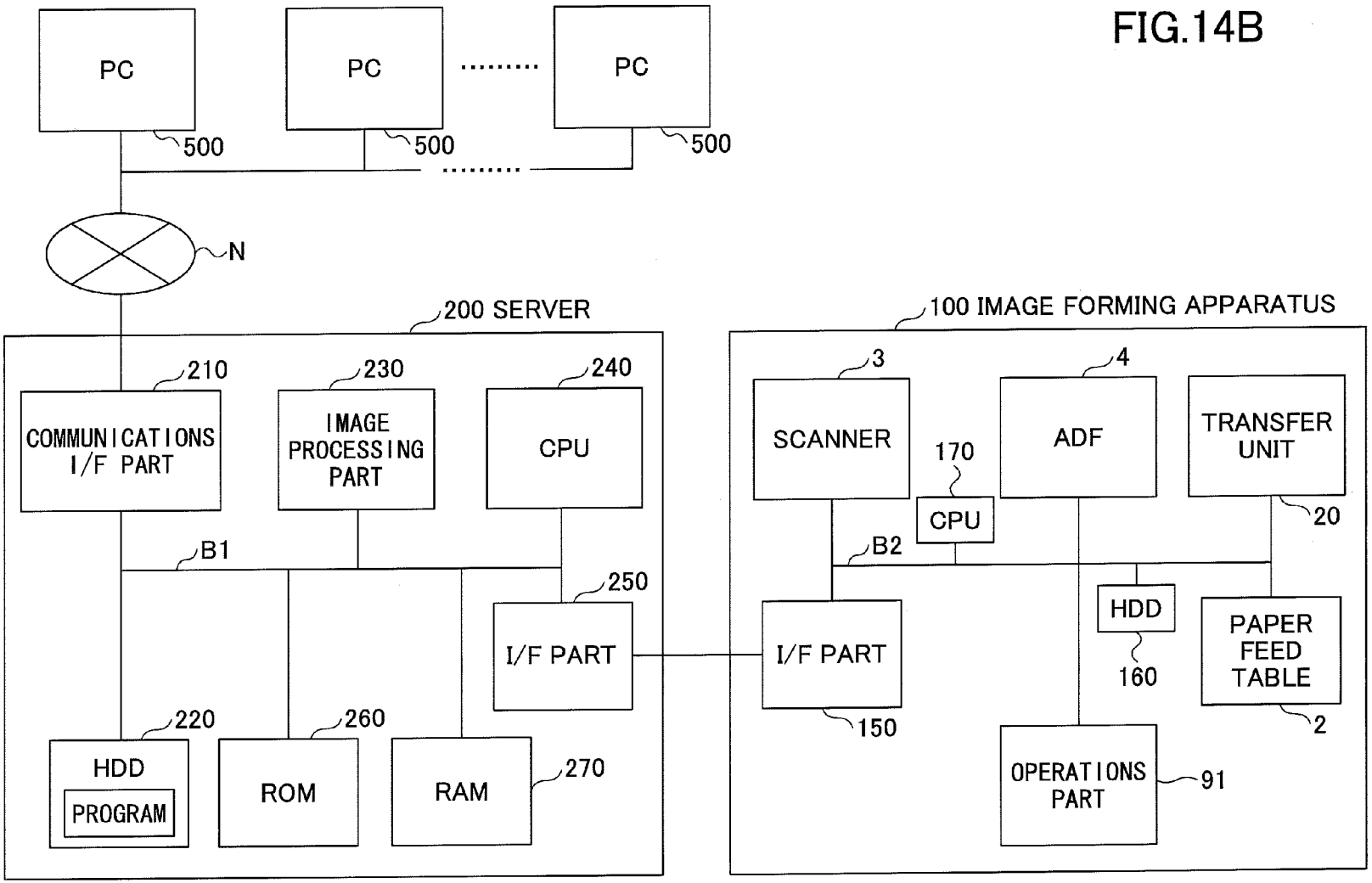

FIG. 14B is a block diagram illustrating the server 200 as well as the image forming apparatus 100. The server 200 includes a communications interface (I/F) part 210, an HDD 220, an image processing part 230, a CPU 240, an I/F part 250, a ROM 260, and a RAM 270, which are interconnected by a bus B1. The image forming apparatus 100 includes an I/F part 150, an HDD 160, and a CPU 170 in addition to the above-described scanner 3, paper feed table 2, ADF 4, and the operations part 91, which are interconnected by a bus B2. The image forming apparatus 100 and the server 200 are connected via their respective I/F parts 150 and 250 through a dedicated line based on RS-232C or its compatible standard or a universal serial bus (USB). The dedicated line is connected to the I/F parts 150 and 250.

The image forming apparatus 100 executes a print job under the control of the server 200. For example, the server 200 receives print data and printing conditions from a personal computer (PC) 500 connected to the server 200 via a network N, and instructs the image forming apparatus 100 to execute printing. The image processing part 230 of the server 200 converts the received print data into print data most suitable for the image forming apparatus 100 by correcting the received print data. The image processing part 230 may also adjust control values (such as fusing temperature and transfer voltage) of the image forming apparatus 100.

A program for implementing the steady-state correction value operation part 83 is stored in the HDD 160 of the image forming apparatus 100. The CPU 170 executes this program to implement the steady-state correction value operation part 83.

As described above in Embodiments 1 and 2, the image forming apparatus 100 calculate the correction or position error. The image forming apparatus 100 may transmit the calculated correction or position error to the server 200. The image forming apparatus 100 may receive the steady-state correction value from the server 200, and store the received steady-state correction value in the memory 86. In this case, the steady-state correction value operation part 83 may be implemented by a program stored in the HDD 220 of the server 200.

According to this embodiment, by prestoring the steady-state correction value calculated by the steady-state correction value operation part 83 in the memory 86, it is possible to reduce the position error. The steady-state correction value operation part 83 may be provided either inside or outside the image forming apparatus 100. The memory 86 may be provided outside the image forming apparatus 100, for example, in the server 200, and the image forming apparatus 100 may receive the steady-state correction value from the server 200 and use the received steady-state correction value for image forming only at a printing time.

[d] Embodiment 4

According to this embodiment, a description is given of a configuration of the image forming apparatus 100 where the rotational speed of the registration roller 49 is controlled by changing the steady-state correction value on a paper kind basis.

Examples of paper that serves as recording paper include various kinds of paper such as plain paper, thick paper, glossy paper, color paper, and tracing paper. Paper differs in thickness and in affinity (such as a coefficient of friction) with the registration roller 49 depending on its kind. Therefore, it is considered that the position error is affected by the kind of paper. Accordingly, by controlling the rotational speed of the registration roller 40 by changing the steady-state correction value on a paper kind basis, it is possible to approximate the steady-state position error to zero irrespective of the kind of paper.

Such control may be performed by storing the steady-state correction value in the memory 86 on a paper kind basis. In the case of Embodiments 1 and 2, a user inputs the kind of the paper P from the operations part 91. Paper kinds such as frequently used plain paper are displayed on the operations part 91 so as to allow the user to select paper to be used for printing. The user may also register a paper kind unique to the user with the image forming apparatus 100.

Instead of a user inputting a paper kind, a paper kind detection sensor may be provided in the conveyance path of the paper P, and the kind of the paper P may be detected with the paper kind detection sensor. For example, the paper kind detection sensor includes a light emitting part and a light receiving part, and detects paper thickness with transmitted light. As a result, it is possible to correct the steady-state position error with respect to paper kinds that differ in thickness.

Further, in the case of Embodiment 3, the steady-state correction values measured by a manufacture on a paper kind basis before shipment are stored in the memory 86 (FIG. 13). Alternatively, the steady-state correction values measured by a maintenance person through periodic maintenance are stored on a paper kind basis in the memory 86.

Figure 15:
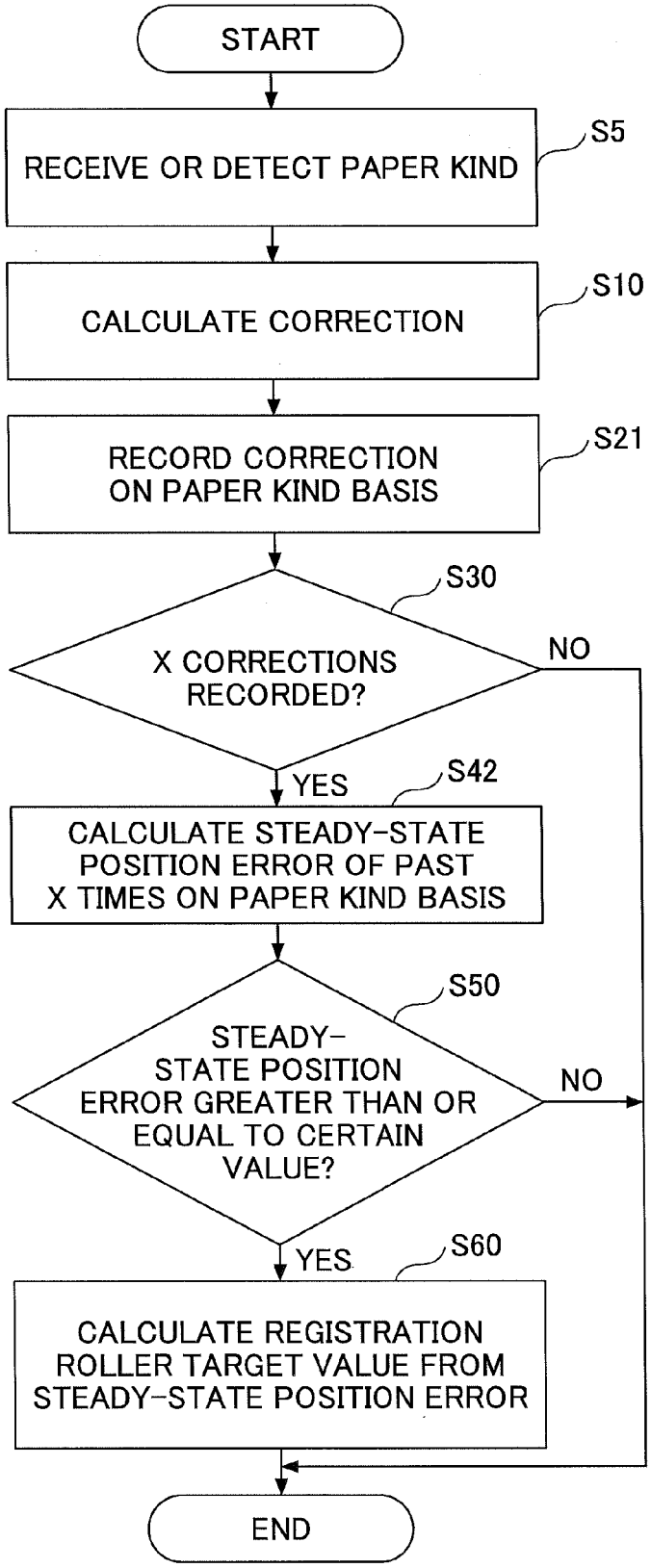
FIG. 15 is a flowchart illustrating a process up to the calculation of a speed command value by the conveyance control part according to a fifth embodiment (Embodiment 4) of the present invention.

FIG. 15 is a flowchart illustrating a process up to the calculation of a speed command value by the conveyance control part 80.

In step S5, the conveyance control part 80 receives a paper kind from a user or determines the paper kind based on the paper thickness detected with a paper kind sensor.

In step S10, the correction operation part (FIG. 13) calculates the correction or position error from the result of paper detection by the paper detection sensor 74 and the Image Write Start signal.

In step S21, the correction operation part 82 records the correction or position error in the memory 86 in correlation with the paper kind.

FIG. 16 is a diagram illustrating corrections stored in the memory 86 on a paper kind basis. These corrections are converted to position errors (mm). The memory 86 contains n corrections for each of Paper Kinds 1, 2, and 3.

In step S30, the steady-state correction value operation part 83 determines whether the correction or the position error has been recorded X times. If the correction or the position error has not been recorded X times (NO in step S30), the process ends without calculating the steady-state correction value.

If the correction or the position error has been recorded X times (that is, if X corrections or X position errors have been recorded) (YES in step S30), in step S42, the steady-state correction value operation part 83 calculates the steady-state correction value from the past (last) X corrections or position errors of a corresponding paper kind recorded in the memory 86.

In step S50, the second control operation part 84 determines whether the steady-state correction value is greater than or equal to a threshold. If the steady-state correction value of the recorded past (last) X corrections or position errors is not greater than or equal to a threshold (NO in step S50), the second control operation part 84 does not change the speed command value.

If the steady-state correction value of the recorded past (last) X corrections or position errors is greater than or equal to a threshold (YES in step S50), in step S60, the second control operation part 84 changes the speed command value by Eq. (1) described above. By changing the speed command value on a paper kind basis, it is possible for the second control operation part 84 to control the registration roller 49 (the second motor 90) so as to cancel out the steady-state position error on a paper kind basis.

According to this embodiment, in addition to the effects of Embodiments 1 to 3 described above, it is possible to control the steady-state position error irrespective of the kind of paper.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An image forming apparatus, comprising:

an image moving unit configured to move an image to a transfer position;

a first recording medium conveyance unit configured to convey a recording medium to a downstream side in a conveying direction;

a second recording medium conveyance unit provided on the downstream side of the first recording medium conveyance unit in the conveying direction, the second recording medium conveyance unit being configured to convey the recording medium, conveyed from the first recording medium conveyance unit, toward the transfer position;

a recording medium detection unit configured to detect a position of the recording medium conveyed by the second recording medium conveyance unit;

a position error detection unit configured to detect a position error between the transfer position and a position at which there is to be the recording medium when the image reaches the transfer position, based on the position of the recording medium detected by the recording medium detection unit;

a position error storage unit configured to store a plurality of position errors detected by the position error detection unit;

a steady-state position error calculation unit configured to calculate a steadily generated steady-state position error from the plurality of position errors stored in the position error storage unit;

a first control unit configured to control a conveyance speed of the first recording medium conveyance unit so as to reduce the steady-state position error; and a second control unit configured to control a conveyance speed of the second recording medium conveyance unit so as to reduce the position error detected by the position error detection unit, with the steady-state position error being reduced by the first control unit.

2. The image forming apparatus as claimed in claim 1, further comprising:

a roller separation unit, wherein the first recording medium conveyance unit is configured to convey the recording medium by rotating a pair of rollers, and the roller separation unit separates the rollers when the recording medium conveyed by the first recording medium conveyance unit reaches the second recording medium conveyance unit.

3. The image forming apparatus as claimed in claim 1, wherein during conveyance of the recording medium by the first recording medium conveyance unit and the second recording medium conveyance unit, the second control unit sets a speed as a target speed of the conveyance speed of the second recording medium conveyance unit, the speed set by the second control unit being equal to a target speed set by the first control unit to reduce the steady-state position error.

4. The image forming apparatus as claimed in claim 1, wherein the steady-state position error calculation unit has the calculated steady-state position error prestored in the position error storage unit.

5. The image forming apparatus as claimed in claim 4, wherein the calculated steady-state position error is prestored on a recording medium kind basis in the position error storage unit.

6. The image forming apparatus as claimed in claim 1, further comprising:

a recording medium determination unit configured to determine a kind of the recording medium or a kind reception unit configured to receive the kind of the recording medium, wherein the position error detection unit detects the position error and stores the detected position error on a recording medium kind basis, and the steady-state position error calculation unit calculates the steady-state position error on a recording medium kind basis from the plurality of position errors stored in the position error storage unit on a recording medium kind basis.

7. The image forming apparatus as claimed in claim 1, further comprising:

a communications unit configured to transmit the steadily generated steady-state position error calculated by the steady-state position error calculation unit to a server connected to the image forming apparatus via a network when the calculated steady-state position error is more than or equal to a threshold.

8. A recording medium conveying method, comprising:

moving an image to a transfer position by an image moving unit;

conveying a recording medium to a downstream side in a conveying direction by a first recording medium conveyance unit;

conveying the recording medium, conveyed from the first recording medium conveyance unit, toward the transfer position by a second recording medium conveyance unit provided on the downstream side of the first recording medium conveyance unit in the conveying direction;

detecting a position of the recording medium conveyed by the second recording medium conveyance unit by a recording medium detection unit;

detecting a position error between the transfer position and a position at which there is to be the recording medium when the image reaches the transfer position, based on the position of the recording medium detected by the recording medium detection unit, by a position error detection unit;

storing a plurality of position errors detected by the position error detection unit by a position error storage unit;

calculating a steadily generated steady-state position error from the plurality of position errors stored in the position error storage unit by a steady-state position error calculation unit;

controlling a conveyance speed of the first recording medium conveyance unit so as to reduce the steady-state position error by a first control unit; and controlling a conveyance speed of the second recording medium conveyance unit so as to reduce the position error detected by the position error detection unit, with the steady-state position error being reduced by the first control unit, by a second control unit.

9. An image forming system, comprising:

an image forming unit, the image forming unit including an image moving unit configured to move an image to a transfer position;

a first recording medium conveyance unit configured to convey a recording medium to a downstream side in a conveying direction;

a second recording medium conveyance unit provided on the downstream side of the first recording medium conveyance unit in the conveying direction, the second recording medium conveyance unit being configured to convey the recording medium, conveyed from the first recording medium conveyance unit, toward the transfer position;

a recording medium detection unit configured to detect a position of the recording medium conveyed by the second recording medium conveyance unit;

a position error detection unit configured to detect a position error between the transfer position and a position at which there is to be the recording medium when the image reaches the transfer position, based on the position of the recording medium detected by the recording medium detection unit; and a position error storage unit configured to store a plurality of position errors detected by the position error detection unit;

a steady-state position error calculation unit configured to calculate a steadily generated steady-state position error from the plurality of position errors stored in the position error storage unit;

a first control unit configured to control a conveyance speed of the first recording medium conveyance unit so as to reduce the steady-state position error; and a second control unit configured to control a conveyance speed of the second recording medium conveyance unit so as to reduce the position error detected by the position error detection unit, with the steady-state position error being reduced by the first control unit.

* * * * *